US009669271B2

(12) United States Patent
Soracco et al.

(10) Patent No.: US 9,669,271 B2
(45) **Date of Patent: *Jun. 6, 2017**

(54) GOLF CLUB HEAD WITH TOP LINE INSERT

(71) Applicant: Cobra Golf Incorporated, Carlsbad, CA (US)

(72) Inventors: Peter L. Soracco, Carlsbad, CA (US); Ryan L. Roach, Carlsbad, CA (US); Thomas C. Morris, Carlsbad, CA (US)

(73) Assignee: COBRA GOLF INCORPORATED, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/144,152

(22) Filed: May 2, 2016

(65) Prior Publication Data

US 2016/0250524 A1 Sep. 1, 2016

Related U.S. Application Data

(63) Continuation of application No. 14/584,515, filed on Dec. 29, 2014, now Pat. No. 9,421,436, which is a (Continued)

(51) Int. Cl.
*A63B 53/04* (2015.01)
*A63B 53/06* (2015.01)
(Continued)

(52) U.S. Cl.
CPC ..... *A63B 53/047* (2013.01); *A63B 53/02* (2013.01); *A63B 53/04* (2013.01);
(Continued)

(58) Field of Classification Search
CPC ... A63B 53/047; A63B 53/0475; A63B 53/02; A63B 53/04; A63B 53/06; A63B 60/54;
(Continued)

(56) References Cited

U.S. PATENT DOCUMENTS 1,319,233 A 10/1919 Mattern
1,320,163 A * 10/1919 Maurice ..... A63B 53/047 473/335
(Continued)

FOREIGN PATENT DOCUMENTS

JP 05-168732 A 7/1993
JP 07-031697 Y2 7/1995
(Continued)

OTHER PUBLICATIONS

Trial Decision in related Japanese Patent application No. 2006-300589, Pub. No. 2009-20956, mailed Jan. 11, 2011 (32 pages).

*Primary Examiner* — Sebastiano Passanti
(74) *Attorney, Agent, or Firm* — Brown Rudnick LLP; Mark S. Leonardo

(57) ABSTRACT

A golf club head having a low-density interchangeable insert located in a top portion thereof. The interchangeable insert may be only in the top line of the club head or extend from the heel around the toe and optionally be visible from above when the club is at address. The interchangeable insert may extend through a hosel and optionally be visible on a heel-side surface. The interchangeable insert may be mounted on a back surface of a striking face, and may extend a distance down the back surface. The interchangeable insert may extend into, and provide part of, a golf ball striking face.

11 Claims, 16 Drawing Sheets

Related U.S. Application Data continuation of application No. 13/904,585, filed on May 29, 2013, now abandoned, which is a continuation of application No. 11/266,180, filed on Nov. 4, 2005, now Pat. No. 8,480,506, which is a continuation-in-part of application No. 10/843,622, filed on May 12, 2004, now Pat. No. 7,481,718, said application No. 14/584,515 is a continuation of application No. 13/772,821, filed on Feb. 21, 2013, now Pat. No. 8,939,848, which is a continuation-in-part of application No. 13/336,630, filed on Dec. 23, 2011, now Pat. No. 8,393,976, which is a continuation-in-part of application No. 12/362,666, filed on Jan. 30, 2009, now Pat. No. 8,088,022, which is a continuation-in-part of application No. 11/896,237, filed on Aug. 30, 2007, now Pat. No. 7,938,737, which is a continuation-in-part of application No. 11/266,172, filed on Nov. 4, 2005, now Pat. No. 7,524,250, which is a continuation-in-part of application No. 10/843,622, filed on May 12, 2004, now Pat. No. 7,481,718.

(51) Int. Cl.
*A63B 53/02* (2015.01)
*A63B 60/54* (2015.01)
*A63B 60/52* (2015.01)

(52) U.S. Cl.
CPC ..... *A63B 53/0475* (2013.01); *A63B 53/06* (2013.01); *A63B 60/54* (2015.10); *A63B 53/0487* (2013.01); *A63B 60/52* (2015.10); *A63B 2053/0408* (2013.01); *A63B 2053/0412* (2013.01); *A63B 2053/0433* (2013.01); *A63B 2053/0437* (2013.01); *A63B 2053/0491* (2013.01); *A63B 2209/00* (2013.01)

(58) Field of Classification Search
CPC .... A63B 2053/0412; A63B 2053/0408; A63B 2053/0491; A63B 53/0487; A63B 2209/00; A63B 60/52; A63B 2053/0433
USPC ..... 473/324–350, 287–292
See application file for complete search history.

(56) References Cited

U.S. PATENT DOCUMENTS 1,534,600 A 4/1925 Mattern
2,429,351 A 10/1947 Fetterolf
2,846,228 A * 8/1958 Reach ..... A63B 53/04 473/332
3,084,940 A 4/1963 Cissel
3,881,733 A 5/1975 Csernits
3,970,236 A 7/1976 Rogers
4,027,885 A 6/1977 Rogers
4,340,230 A 7/1982 Churchward
4,398,965 A 8/1983 Campau
4,523,759 A 6/1985 Igarashi
4,607,846 A 8/1986 Perkins
4,687,205 A 8/1987 Tominaga et al.
4,811,950 A 3/1989 Kobayashi
4,826,172 A * 5/1989 Antonious ..... A63B 53/04 473/242
4,874,171 A 10/1989 Ezaki et al.
4,883,274 A * 11/1989 Hsien ..... A63B 53/04 473/335
4,919,431 A * 4/1990 Antonious ..... A63B 53/04 473/350
4,928,972 A 5/1990 Nakanishi et al.
4,957,294 A 9/1990 Long
D321,920 S 11/1991 Parente et al.
5,104,457 A * 4/1992 Viljoen ..... A63B 53/04 148/436
5,110,131 A 5/1992 Long
5,221,087 A 6/1993 Fenton et al.
D339,183 S 9/1993 Stites, III
D343,216 S 1/1994 Chorne
5,303,922 A 4/1994 Lo
5,316,298 A 5/1994 Hutin et al.
5,377,979 A 1/1995 Long
5,377,985 A 1/1995 Ohnishi
5,409,229 A * 4/1995 Schmidt ..... A63B 53/04 473/332
5,413,336 A 5/1995 Iwanaga
5,439,223 A 8/1995 Kobayashi
5,492,327 A 2/1996 Biafore
5,544,885 A 8/1996 Besnard et al.
5,564,705 A 10/1996 Kobayashi et al.
5,584,770 A 12/1996 Jensen
5,586,947 A 12/1996 Hutin
5,593,356 A 1/1997 Takeda
5,599,243 A 2/1997 Kobayashi
5,616,088 A 4/1997 Aizawa et al.
5,643,112 A 7/1997 Besnard et al.
5,658,208 A * 8/1997 Shimasaki ..... A63B 53/04 473/349
5,669,826 A 9/1997 Chang et al.
5,697,855 A * 12/1997 Aizawa ..... A63B 53/04 473/332
5,772,527 A 6/1998 Liu
5,816,936 A 10/1998 Aizawa et al.
5,938,540 A 8/1999 Lu
6,015,354 A * 1/2000 Ahn ..... A63B 53/04 473/256
6,042,486 A 3/2000 Gallagher
6,080,069 A 6/2000 Long
6,093,112 A 7/2000 Peters et al.
RE36,950 E 11/2000 Allen
6,200,228 B1 * 3/2001 Takeda ..... A63B 53/04 473/324
6,206,790 B1 * 3/2001 Kubica ..... A63B 53/04 473/335
6,302,807 B1 10/2001 Rohrer
6,306,048 B1 10/2001 McCabe et al.
6,332,848 B1 12/2001 Long et al.
6,443,857 B1 9/2002 Chuang
6,478,690 B2 11/2002 Helmstetter et al.
6,592,469 B2 7/2003 Gilbert
6,688,989 B2 2/2004 Best
6,702,693 B2 3/2004 Bamber
6,769,998 B2 8/2004 Clausen et al.
6,773,361 B1 8/2004 Lee
6,814,674 B2 11/2004 Clausen et al.
6,830,519 B2 12/2004 Reed et al.
6,835,144 B2 * 12/2004 Best ..... A63B 53/047 473/332
6,902,495 B2 6/2005 Pergande et al.
6,921,344 B2 7/2005 Gilbert et al.
6,929,563 B2 8/2005 Nishitani
7,014,571 B2 3/2006 Deshmukh
7,048,648 B2 5/2006 Breier et al.
7,244,188 B2 7/2007 Best
7,303,486 B2 12/2007 Imamoto
7,390,270 B2 * 6/2008 Roberts ..... A63B 53/047 473/332
7,481,718 B2 1/2009 Soracco
7,524,250 B2 4/2009 Soracco
7,563,176 B2 * 7/2009 Roberts ..... A63B 53/047 473/329
7,588,503 B2 9/2009 Roach et al.
7,621,822 B2 11/2009 Roach
7,686,704 B2 3/2010 Gilbert et al.
7,815,523 B2 * 10/2010 Knutson ..... A63B 53/047 473/349
7,815,524 B2 10/2010 Bamber
7,938,737 B2 5/2011 Soracco
7,938,738 B2 5/2011 Roach
7,997,999 B2 * 8/2011 Roach ..... A63B 53/047 473/332

(56) References Cited

U.S. PATENT DOCUMENTS

| | | | | |
|---|---|---|---|---|
| 8,057,322 | B2 * | 11/2011 | Wallans | A63B 53/047 473/329 |
| 8,088,022 | B2 | 1/2012 | Soracco et al. | |
| 8,152,651 | B2 | 4/2012 | Roach | |
| 8,323,122 | B2 | 12/2012 | Soracco et al. | |
| 8,393,976 | B2 | 3/2013 | Soracco et al. | |
| 8,480,506 | B2 | 7/2013 | Soracco et al. | |
| 8,632,419 | B2 | 1/2014 | Tang et al. | |
| 8,827,831 | B2 | 9/2014 | Burnett et al. | |
| 8,939,848 | B2 * | 1/2015 | Soracco | A63B 53/0475 473/329 |
| 9,421,436 | B2 * | 8/2016 | Soracco | A63B 53/0475 |
| 2001/0001774 | A1 * | 5/2001 | Antonious | A63B 53/04 473/349 |
| 2002/0042307 | A1 | 4/2002 | Deshmukh | |
| 2002/0094883 | A1 | 7/2002 | Chuang | |
| 2002/0107087 | A1 | 8/2002 | Fagot | |
| 2002/0165041 | A1 | 11/2002 | Takeda | |
| 2003/0032499 | A1 | 2/2003 | Wahl et al. | |
| 2003/0045372 | A1 | 3/2003 | Vrska | |
| 2003/0092502 | A1 | 5/2003 | Pergande et al. | |
| 2003/0125129 | A1 | 7/2003 | Saksun | |
| 2004/0023730 | A1 | 2/2004 | Nagai et al. | |
| 2004/0116200 | A1 | 6/2004 | Helmstetter et al. | |
| 2004/0204263 | A1 | 10/2004 | Fagot et al. | |
| 2005/0096151 | A1 | 5/2005 | Hou et al. | |
| 2005/0143190 | A1 | 6/2005 | Takeda | |
| 2005/0277484 | A1 | 12/2005 | Reed et al. | |
| 2005/0277485 | A1 | 12/2005 | Hou et al. | |
| 2006/0025234 | A1 | 2/2006 | Nicolette et al. | |
| 2006/0052184 | A1 | 3/2006 | Soracco et al. | |
| 2007/0129166 | A1 | 6/2007 | Shimazaki et al. | |
| 2008/0015051 | A1 | 1/2008 | Roach et al. | |
| 2008/0051220 | A1 | 2/2008 | Soracco et al. | |
| 2009/0221382 | A1 | 9/2009 | Soracco et al. | |
| 2010/0056297 | A1 | 3/2010 | Roach et al. | |

FOREIGN PATENT DOCUMENTS

| | | | |
|---|---|---|---|
| JP | H07213656 | A | 8/1995 |
| JP | 08-024379 | A | 1/1996 |
| JP | 08-57088 | A | 3/1996 |
| JP | 08-206258 | A | 8/1996 |
| JP | 08-257181 | A | 10/1996 |
| JP | 3032837 | U | 1/1997 |
| JP | 9-173513 | A | 7/1997 |
| JP | 9-225075 | A | 9/1997 |
| JP | 11-226158 | A | 8/1999 |
| JP | 2000-153008 | A | 6/2000 |
| JP | 2001-161870 | A | 6/2001 |
| JP | 2003-093550 | A | 4/2003 |
| JP | 2006-300589 | A | 11/2006 |
| JP | 04-082576 | B2 | 4/2008 |
| JP | 3145482 | U | 10/2008 |
| WO | 2005/082062 | A3 | 11/2005 |

* cited by examiner

GOLF CLUB HEAD WITH TOP LINE INSERT

CROSS-REFERENCE TO RELATED APPLICATION

This application is a continuation of U.S. patent application Ser. No. 14/584,515, filed Dec. 29, 2014, which application is a continuation of U.S. patent application Ser. No. 13/772,821, filed Feb. 21, 2013, which is a continuation-in-part of U.S. patent application Ser. No. 13/336,630, filed Dec. 23, 2011, now U.S. Pat. No. 8,393,976, which is a continuation of U.S. patent application Ser. No. 12/362,666, filed Jan. 30, 2009, now U.S. Pat. No. 8,088,022, which is a continuation-in-part of U.S. patent application Ser. No. 11/896,237, filed Aug. 30, 2007, now U.S. Pat. No. 7,938,737, which is a continuation-in-part of U.S. patent application Ser. No. 11/266,172, filed Nov. 4, 2005, now U.S. Pat. No. 7,524,250, which is a continuation-in-part of U.S. patent application Ser. No. 10/843,622, filed May 12, 2004, now U.S. Pat. No. 7,481,718, the contents of each of which are incorporated herein by reference in their entirety.

U.S. patent application Ser. No. 14/584,515, filed Dec. 29, 2014 is also a continuation of U.S. patent application Ser. No. 13/904,585, filed May 29, 2013, which is a continuation of U.S. patent application Ser. No. 11/266,180, filed Nov. 4, 2005, now U.S. Pat. No. 8,480,506, which is a continuation-in-part of U.S. patent application Ser. No. 10/843,622, filed May 12, 2004, now U.S. Pat. No. 7,481,718, the contents of each of which are incorporated herein by reference in their entirety.

FIELD OF THE INVENTION

The present invention relates to a golf club, and, more particularly, to a golf club head having a top line recess with an insert.

BACKGROUND

Golf club designers who want to make a club that is forgiving and easy to hit may turn to a multi-material or cavity-backed construction. Some such designs replace certain areas of the club head, such as the striking face or sole, with a second material that can be either heavier or lighter than the first material. By incorporating additional materials of varying densities or providing cavities and undercuts, mass can be "freed up" and used in perimeter weighting to enhance the moment of inertia. However, due to construction limitations or requirements, some of these designs inadvertently thicken the top portion of the club head.

Where a club head has a body made of a dense material such as metal, thickening the top portion of the club head raises the center of gravity. Unfortunately, this has adverse effects on playability. Some golfers find a club most useful if the center of gravity is low, getting the weight of the club head under the ball.

SUMMARY

The present invention relates to a golf club head that has an insert at a top portion of the head. The insert can include a material that is less dense than other materials in the club head. Since the insert at the top of the club includes a low-density material, inclusion of the insert lowers the club head center of gravity. A low density insert thus offsets effects of thickening a top portion of a golf club that may arise when designing a multi-material club head or a club head with pronounced perimeter weighting. The useful mass-distribution benefits of an insert near a top portion of a club head can be increased by extending the insert and the useful vibration-dampening benefits of an insert can be increased by its mounting arrangement. Disposing an insert so that it makes contact with a back of a club head striking face may dampen unwanted vibrations and improve a club face coefficient of restitution. Extending an insert into a hosel area, heel area, toe side area, face area, back side area, or combination thereof can further lower a club head center of gravity. Additionally, extending an insert through a hosel so that it appears on a hosel side surface of the club head can improve the club head's response to fitting, which involves mounting the club head in a fitting station and bending it into a certain conformation with a cheater bar. Thus, an insert of the invention may extend through a hosel or into a toe side area, may be mounted on a back of a club face and may extend down the club face back, and may even extend down a portion of the front surface of the club face and form part of the hitting surface.

In certain aspects, the invention provides a golf club head that has a face portion with a front surface for striking a golf ball and a body portion supporting the face portion. The body portion includes a heel, a toe, a sole, and a top line. The top line includes a recess extending between the heel and the toe along the top line. The recess includes a channel having a substantially rearward-facing surface facing a substantially forward-facing surface when the club is at address. The golf club head further includes an interchangeable insert positioned within the recess, wherein the interchangeable insert includes a material with a density lower than a density of the body portion of the club head. In some embodiments, the interchangeable insert may be releasably coupled to and retained within a portion of the channel of the recess via a press fit or adhesive.

The ability to provide interchangeable inserts with a club head provides a golfer with the ability to customize a club head. This is beneficial due to the properties individual inserts. For example, in some embodiments, an interchangeable insert may provide good vibration-dampening benefits to a club head. Where a club head comes with a plurality of inserts, each of the plurality of inserts may have a different elastic modulus. A golfer can chose the insert that provides the requisite amount of vibration-dampening and insert it into the club head (e.g., to be mounted there by press-fit, golfer-applied adhesive, or other means).

In some embodiments, the body portion is formed of a first material with a first specific gravity and the interchangeable insert is formed of a second material with a second specific gravity. The second specific gravity may be different than the first specific gravity. In some embodiments, the club head satisfies the relationship $I_{ZZ} \geq CG_Z*170$, where $I_{ZZ}$ is the rotational moment of inertia about a vertical axis and has units of $g/cm^2$ and $CG_Z$ is the center of gravity and has units of mm. In some embodiments, the second specific gravity is greater than the first specific gravity by at least about 3. The club head may satisfy the relationship $IZZ > CG_Z*SG*17$, wherein SG is the second specific gravity. In some embodiments, the second specific gravity may be less than the first specific gravity by at least about 3. The club head may satisfy the relationship $I_{ZZ} > CG_Z*SG*130$, wherein SG is the second specific gravity.

In certain aspects, the invention provides a golf club head that has a face portion with a front surface for striking a golf ball and a body portion supporting the face portion. The body portion includes a heel, a toe, a sole, and a top line. The top line includes a recess extending between the heel and the toe along the top line. The recess includes a channel having a substantially rearward-facing surface facing a substantially forward-facing surface when the club is at address. The recess may be configured to receive and retain one of a plurality of interchangeable inserts within. At least one of the plurality of interchangeable inserts includes a material with a density lower than a density of the body portion of the club head. Each of the plurality of interchangeable inserts is configured to be releasably coupled to and retained within a portion of the channel of the recess via a press fit or adhesive.

In certain aspects, the invention provides an iron-type golf club head that has a face portion with a front surface for striking a golf ball and a body portion supporting the face portion and comprising a heel, a sole, a toe, and a top line. The top line has at least two internal surfaces facing inward to define a recess, and the recess extends through the hosel and is accessible from a heel-side surface of the club head and at least a portion of the recess is accessible from above when the club head is at address. The insert may use a material with a density lower than a density of the club head. The insert may be disposed within the recess.

An insert that extends through the hosel to the heel provides weight saving benefits in that it removes material from the hosel. Additionally or alternatively, including a recess for an insert extending through a hosel provides a benefit in facilitating hosel bending. Many club hits are fit to a customer's specifications by loading the club head into a fitting station machine and bending the hosel into the desired configuration. In some prior art club heads, this has led to problems with visible metal fatigue or bend lines. A recess in the hosel area provides a seed point for folding, allowing hosel material to gently redistribute during bending without straining the material. Once bent into a final position, a viscoelastic insert can be placed therein to provide a smooth finish on the hosel side surface of the club head body so that the recess does not interfere with the club head aerodynamics or trap detritus from the environment.

In certain embodiments, the insert is shaped to aid in bending of the hosel. For example, an insert may have an accordion structure. In an accordion structure, a surface of the insert has an alternating pattern of protruding flanges and grooves. The insert may have a void space within to aid in deformation, be substantially hollow (e.g., thin-walled), or be solid throughout. In a related embodiment, a recess may have at least one groove, depression, annular ring, or v-shaped notch extending along a surface to facilitate deformation.

In some embodiments, one of the two internal surfaces is provided by a back surface of the face portion and the insert is disposed adjacent to the back surface of the face portion. The insert may extend down the back surface of the face portion lower than the topline. In some embodiments, the insert is, colored, translucent, or clear. In certain embodiments, the insert is interchangeable by a golfer. A color may be included to indicate to a golfer an amount of vibration-dampening offered by the particular insert (e.g., green for comfort, red for performance).

In some embodiments, the top line includes a protrusion extending into the insert. The insert may be mounted on a surface that includes one or more micro-cavities to strengthen the attachment (micro is used as a prefix to distinguish from the cavity of a cavity-backed iron and does not limit the size of the cavities). In certain embodiments, the insert is co-molded with the club head and the material extends into the one or more micro-cavities.

The recess and the insert may extend from the heel surface, around a top line—toe transition, and into a toe-side surface. A portion of the recess along the topline may provide the two internal surfaces facing inward (e.g., substantially parallel to, and facing, each other) and have a floor surface extending between the two internal surface that faces upwards when the club is at address.

BRIEF DESCRIPTION OF THE DRAWINGS

Further features and advantages of the invention can be ascertained from the following detailed description that is provided in connection with the drawing(s) described below.

DETAILED DESCRIPTION

The present invention is directed to a golf club head with a top line insert. The top line insert may be fashioned in a variety of ways according to the invention. For example, in one embodiment, a recess and optional insert is located in the top line of the club head and extends along the top line. In another embodiment, the recess and optional insert extends around the toe of the club head. The insert may be formed of a variety of materials. For example, the insert may be lighter than the body of the club head to adjust the center of gravity downward. Alternatively, the insert may be heavier than the body of the club head to adjust the center of gravity upward. Each of the various embodiments are discussed in greater detail below and demonstrated with representative drawings.

The recess and optional insert may be used in a variety of club heads. For example, the club head may be a long iron, a short iron, or a set including both long and short irons where the recess and optional insert is tailored to adjust the club head center of gravity and other club head properties such as moment of inertia. In addition, the present invention is contemplated for use with utility-type club heads and putter club heads.

Figure 1:
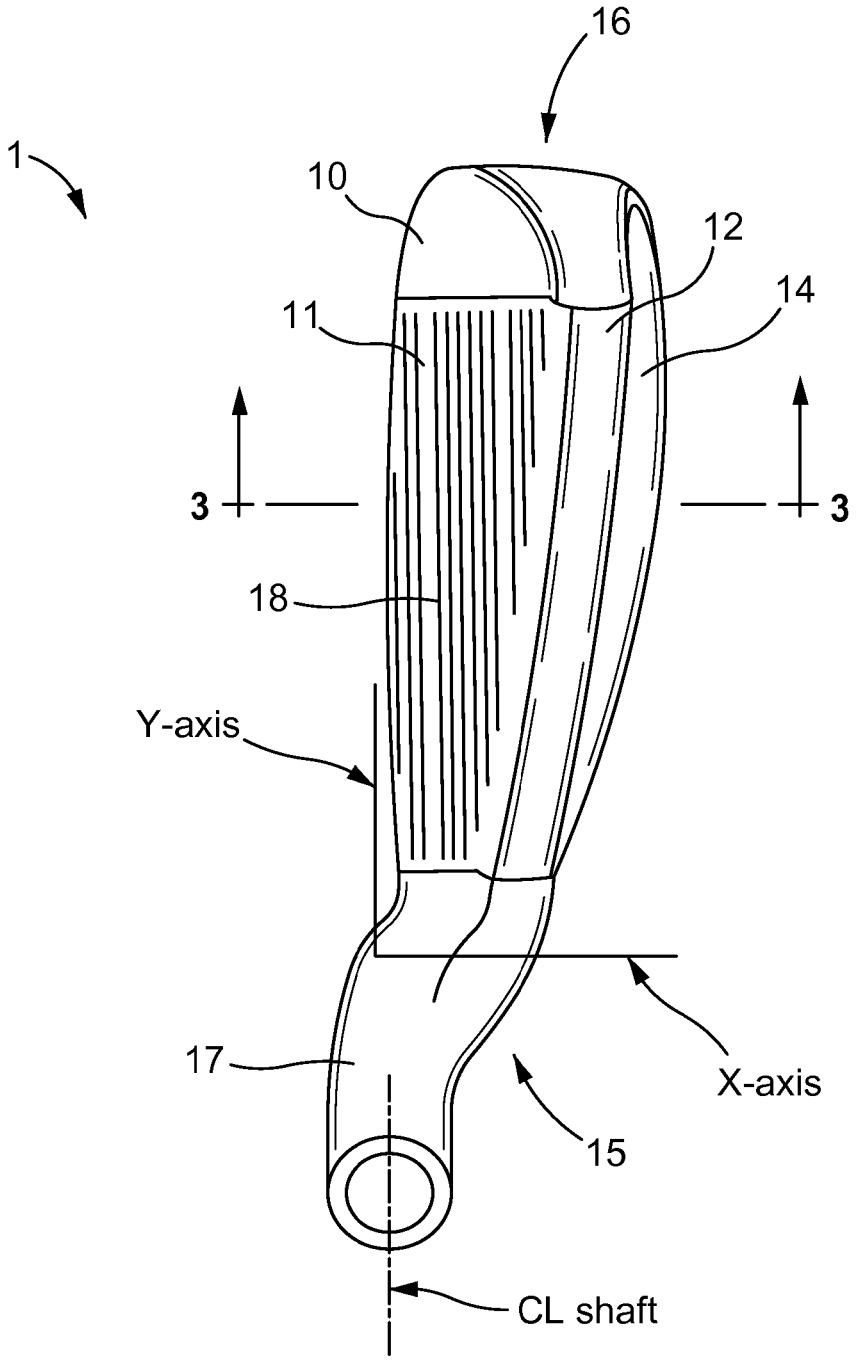
FIG. 1 is a top view of a golf club head of the present invention.
Figure 2:
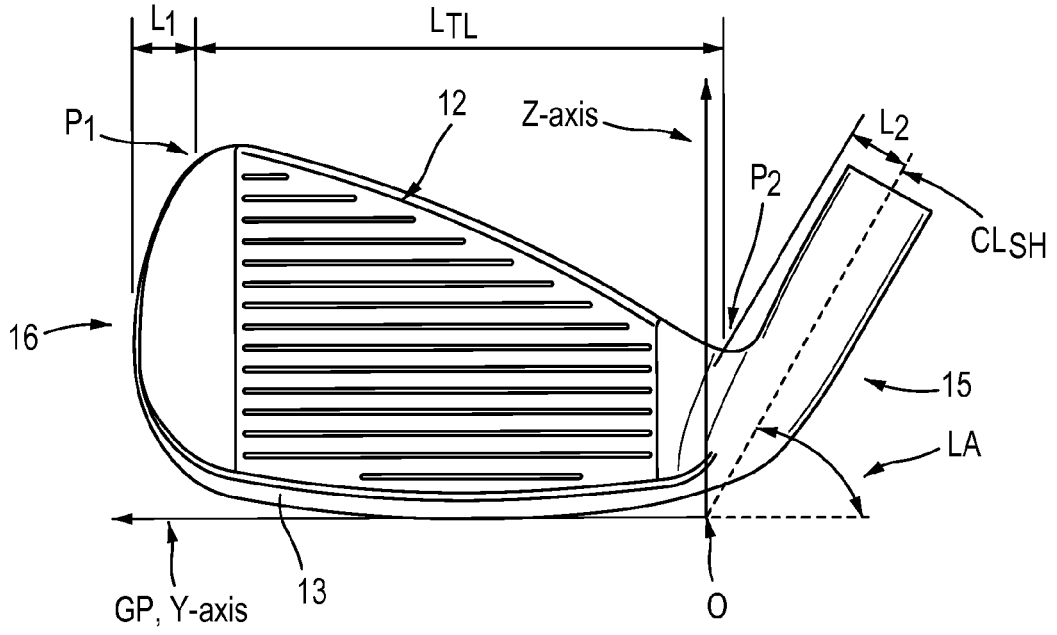
FIG. 2 is a front view of the golf club head of FIG. 1.

FIG. 1 is a top view of a golf club head 1 of the present invention and FIG. 2 is a front view of the golf club head 1. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. While the club head 1 is illustrated as an iron-type golf club head, as briefly discussed above, the present invention may also pertain to a utility-type golf club head or a putter-type club head.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as the vector perpendicular to the X-axis and directed toward the toe 16. A Z-axis is defined as the cross product of the X-axis and the Y-axis.

Figure 3:
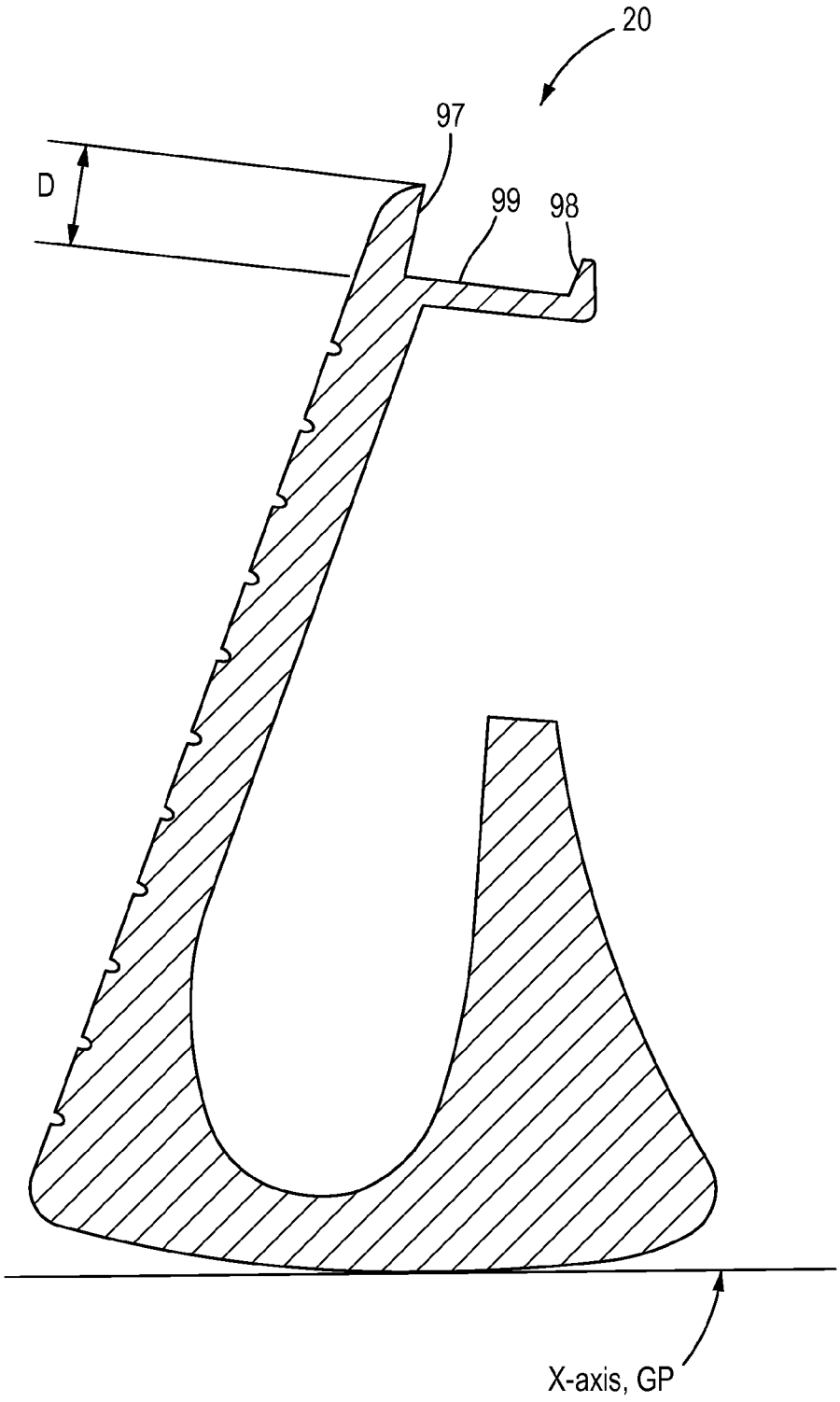
FIG. 3 is a cross-sectional view of the golf club head of FIG. 1 taken along lines 3-3.

FIGS. 2 and 3 show a club head in which the top portion of the club head contains a recess 20 therein, located between the heel 15 and the toe 16 and extending toward the sole 13. In this aspect of the invention, the recess 20 is preferably located in the top line 12 of the club head 1 and extends along the top line 12. The recess 20 removes material from the club head and, thus, allows redistribution of the material to other areas of the club head to do one or more of the following: increase the overall size of the club head 1, expand the size of the club head sweet spot, reposition the club head center of gravity, and/or produce a greater moment of inertia (MOI) measured about either an axis parallel to the Y-axis or Z-axis passing through the club head center of gravity.

As known to those of ordinary skill in the art, MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Thus, moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI.

In one embodiment, the recess 20 is located in the top line 12 of the club head 1 and extends along the top line 12 from about 10 percent to about 95 percent of the top line length. The top line length $L_{TL}$ is defined as the distance along the top line 12 from a point $P_1$ to a point $P_2$. Point $P_1$ is defined as the intersection of the golf club head 1 and a plane that is offset 5.08 mm ($L_1$) from and parallel to a plane defined by the X-axis and the Z-axis tangent to the toe 16 at the toe's furthest point from the origin O along the Y-axis. Point $P_2$ is defined as the uppermost intersection of the club head 1 and a plane that is parallel to the plane formed by the shaft centerline $CL_{SH}$ and the X-axis offset a distance of 7.62 mm ($L_2$) in a direction closer to the toe 16.

In another embodiment, the recess extends along the top line from about 10 percent to about 50 percent of the top line length. In yet another embodiment, the recess extends along the top line from about 15 percent to about 45 percent of the top line length. In still another embodiment, the recess extends along the top line from about 30 percent to about 50 percent of the top line length. The recess may also extend along the top line from about 60 percent to about 95 percent, preferably from about 70 percent to about 95 percent.

In yet another embodiment, the recess completely extends along the top line. For example, the recess extends along 100 percent of the top line length. In another embodiment, the recess extends along the complete length of the top line and wraps around to extend into the toe of the club head. For example, the recess may extend around the top line—toe transition to a point about halfway around the toe of the club head toward the sole.

The recess 20 preferably has a volume of about 0.001 $in^3$ to about 0.2 $in^3$. In one embodiment, the volume of the recess is about 0.005 $in^3$ to about 0.15 $in^3$. In another embodiment, the volume of the recess is about 0.01 $in^3$ to about 0.10 $in^3$. In yet another embodiment, the volume of the recess is about 0.05 $in^3$ to about 0.09 $in^3$.

In relative terms, the recess 20 has a volume that is from about 0.5 percent to about 10 percent of the volume of the body 10. In one embodiment, the recess has a volume of about 1 percent to about 8 percent of the volume of the body. In another embodiment, the recess has a volume of about 2 percent to about 7 percent of the volume of the body. In still another embodiment, the recess has a volume of about 3 percent to about 5 percent of the volume of the body.

The recess 20 preferably has a depth D from about 0.254 mm to about 6.35 mm. For example, the recess may have a depth D of about 1.27 mm to about 5.08 mm. In one embodiment, the depth D of the recess is about 2.032 mm to about 3.81 mm. In still another embodiment, the recess has a depth D of about 2.54 mm to about 5.08 mm.

The recess may have a varying depth. For example, in one embodiment, a first portion of the recess has a depth $D_1$ of about 10 percent to about 90 percent of the depth $D_2$ of a second portion of the recess. In one embodiment, a first portion of the recess has a depth $D_1$ about 20 percent to about 80 percent of the depth $D_2$ of a second portion of the recess. For example, when the recess extends around the toe toward the sole, the first portion may be the portion that extends from the toe toward the sole and the second portion may be the portion that extends along the top line of the club. In an alternate embodiment, the recess has a constant depth.

Figure 4:
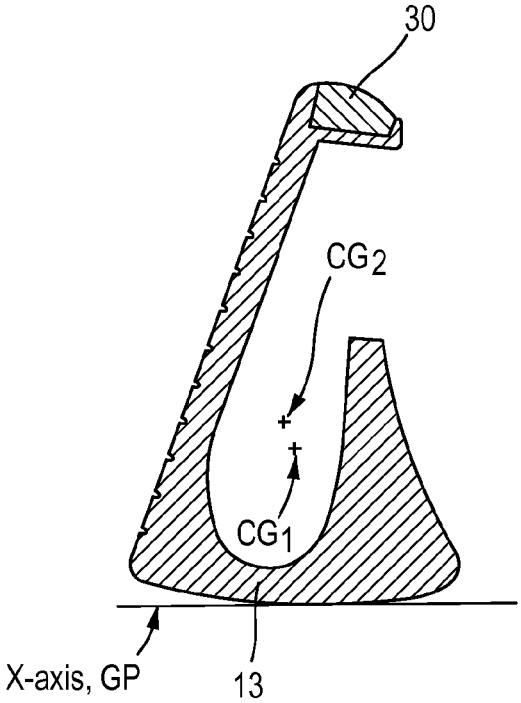
FIG. 4 is a cross-sectional view of the golf club head of FIG. 1, including a low density insert, taken along lines 3-3.
Figure 5:
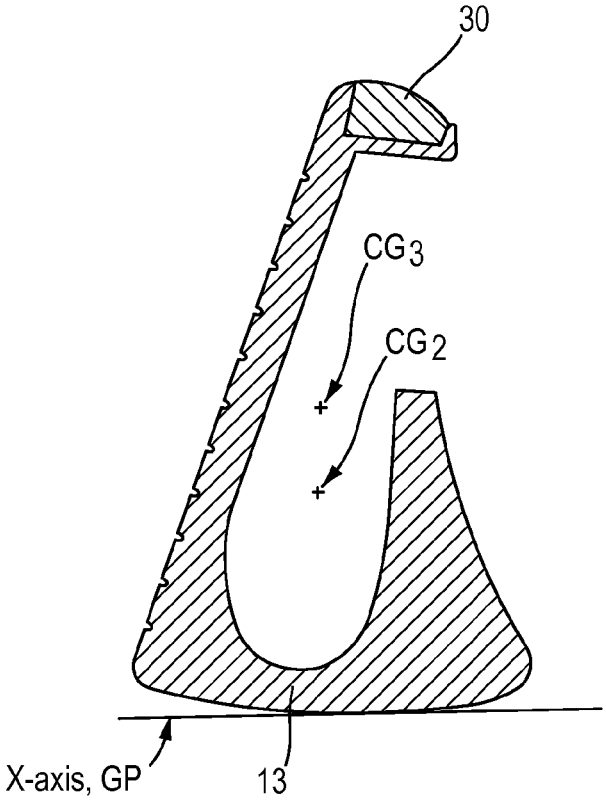
FIG. 5 is a cross-sectional view of the golf club head of FIG. 1, including a high density insert, taken along lines 3-3.

FIGS. 3-5 show embodiments in which a portion of a recess along the topline comprises two internal surfaces facing inward and a floor surface extending between the two internal surface and facing upwards when the club is at address.

FIG. 4 illustrates an insert 30 positioned within the recess 20. The insert 30, which may be either a preformed insert or cast in place within the recess 20, may be configured to matingly correspond to the recess 20. That is, the insert 30 may be formed and configured to match the contours of the recess 20 and to substantially fill the recess 20. Alternatively, the insert 30 fills only a portion of the recess 20. In addition, the insert may be a single piece or may be formed from at least two pieces that are not connected. For example, a the insert may be at least two separate inserts that are used to fill portions of the recess 20. The separate portions may be formed of the same material or different materials. For example, when the recess extends around the top-line—toe transition to a point in the toe of the club head, a first insert may be selected for at least a portion of the top line length and a second recess may be selected for the portion of the recess found in the toe of the club head.

In one embodiment, the insert 30 has a density that is less than the density of the club head body 10. As used herein, "density" is also intended to relate to "specific gravity". For example, because specific gravity is merely the ratio of the density of a given solid or liquid substance to the density of water at a specific temperature and pressure, these terms are used interchangeably when discussing the relative density or specific gravity of the insert as compared to other portions of the club (such as the body) or other inserts in the club. Since the mass of the insert 30 is less than the mass removed by the recess 20, the extra mass may be replaced in more desirous locations on the club head 1. These locations may include, for example, the club head perimeter and/or the sole 13. Alternatively, no additional mass is added to the club head 1; rather, only the recess 20 and the insert 30 are used to enhance the playing characteristics of the golf club.

A body's center of gravity is determined by its weight distribution. Mass added or removed directly on the center of gravity will have no effect on the center of gravity's location. In contrast, mass added or removed far away from the center of gravity will have the greatest effect on moving the center of gravity. Removing mass from the highest areas of a club head will have the greatest effect on lowering the center of gravity. Adding the mass removed from the high areas to the bottom of the club head will further lower the center of gravity. The top line area and top-of-hosel area are the two highest vertical areas in relation to the ground plane on an iron-type head (when the head is at the address position). By removing the top line portion of the face from the casting and replacing it with, for example, a lightweight viscoelastic piece, anywhere from 20-50 grams are removed from the top of the head, depending upon the design of the viscoelastic piece. That weight is redistributed to the bottom portion of the club, lowering the center of gravity even further versus that same club head constructed entirely of a metallic material, such as steel.

MOI is also a property that is affected by mass distribution. Bodies that have mass distributed far from the center of gravity have higher MOI's about their center of gravity than bodies that have mass concentrated near their center of gravity. Removing the mass from the top of the face lowers the MOI about the center of gravity with respect to certain axes. The axis of rotation that relates to an iron's forgiveness is rotation in the heel-toe direction about the center of gravity—an axis parallel to the Z-axis. A higher MOI about this axis indicates greater resistance to twisting on off-center hits and, thus, more forgiveness. By adding the mass removed from the top line 12 back into the low-heel and low-toe areas of the club head, the reduction in MOI in the heel-toe direction due to removal of metallic material from the top line 12 is minimized.

In this aspect of the invention, the insert 30 may have a density from approximately 0.5 g/cm$^3$ to approximately 5 g/cm$^3$, and is preferably less than the body density by at least about 3 g/cm$^3$. For example, a low density insert may have a density between about 1.2 g/cm$^3$ to about 2 g/cm$^3$. Preferably, the specific gravity of the insert in this embodiment is less than 1.5 g/cm$^3$. Ideally, the specific gravity of the insert in this embodiment is less than 1.3 g/cm$^3$.

In one embodiment, the density of the insert is less than the body density by at least about 4 g/cm$^3$. In another embodiment, the density of the insert is less than the body density by at least about 5 g/cm$^3$. The net effect of creating the recess 20 and adding the lower density insert 30 lowers the club head center of gravity ($CG_1$ in FIG. 4) at least about 0.254 mm toward the sole 13, as compared to the center of gravity location of a club head without the recess 20 and the insert 30 ($CG_2$ in FIG. 4). That is, the golf club head 1 has a center of gravity located at least 0.254 mm from a center of gravity location for a substantially similar golf club head without the recess 20 and the insert 30. More preferably, the club head center of gravity is lowered at least 1.0 mm toward the sole 13. Ideally, the club head center of gravity is lowered at least 2 mm toward the sole 13.

Suitable materials for a low density insert include, but are not limited to, nylon, glass fiber reinforced nylon, polyurethane, silicon, rubber, bulk molding compound, thermoplastics, thermosets, resins, and combinations thereof.

Table 1 shows a comparison of center of gravity locations and MOI's for a 6-iron having a urethane insert 30 to a similar club head formed completely of steel. Note that the measurements presented in Table 1 do not include any weights that may be added to the club head.

TABLE 1

| | 6-iron with Urethane Top Line | 6-iron with Steel Top Line |
|---|---|---|
| Head mass (g) | 238.3 | 240.2 |
| Top line mass (g) | 4.9 | 31.1 |
| Total mass (g) | 243.2 | 271.3 |
| $CG_Y$ (mm) | 34.4 | 35.48 |
| $CG_Z$ (mm) | 19.46 | 21.89 |
| $CG_X$ (mm) | 12.14 | 13.54 |
| $I_{YY}$ (g · cm$^2$) | 541 | 740 |
| $I_{ZZ}$ (g · cm$^2$) | 2588 | 2764 |
| $I_{XX}$ (g · cm$^2$) | 2832 | 3110 |

$CG_x$, $CG_y$, and $CG_Z$ are the x-, y-, and z-components of the center of gravity location, respectively. $I_{xx}$, $I_{yy}$, and $I_{ZZ}$ are the MOI's about the x-, y-, and z-axes, respectively.

In the alternative, the insert 30 may have a higher density than the body. For example, the insert 30 may have a density greater than about 5 g/cm$^3$, preferably greater than about 7 g/cm$^3$, and more preferably greater than about 9 g/cm$^3$, and is preferably more than the body density by at least about 1 g/cm$^3$. For example, the insert may have a density of about 12 g/cm$^3$ to about 15 17 g/cm$^3$, preferably about 13 g/cm$^3$ to about 16 g/cm$^3$, and more preferably about 14 g/cm$^3$ to about 15 g/cm$^3$. In one embodiment, the density of the insert is greater than the body density by at least about 2 g/cm$^3$, preferably about 3 g/cm$^3$ or more, more preferably about 4 g/cm$^3$ or more, and even more preferably about 5 g/cm$^3$ or more.

Without being bound to any particular theory, adding mass to the top line raises the center of gravity and the moment of inertia of the club head. In particular, the net effect of creating the recess 20 and adding the higher density insert 30 raises the club head center of gravity ($CG_3$ in FIG. 5) at least about 0.254 mm toward the top of the club head, as compared to the center of gravity location of a club head without the recess 20 and the insert 30 ($CG_2$ in FIG. 5). That is, the golf club head 1 has a center of gravity located at least about 0.254 mm above a center of gravity location for a substantially similar golf club head without the recess 20 and the insert 30. More preferably, the club head center of gravity is raised at least 0.635 mm toward the top of the club head. In this aspect of the invention, the club head center of gravity may be raised about 0.762 mm above a center of gravity location for a substantially similar golf club head without the recess 20 and the insert 30.

In this aspect of the invention, the recess 20 and the insert 30 may increase the club head MOI measured about an axis parallel to the Z-axis and passing through the center of gravity by at least 20 gm·cm$^2$. That is, the club head 1 has an increase in MOI measured about a vertical axis passing through the center of gravity of at least 20 gm·cm$^2$ compared to a substantially similar golf club head without the recess 20 and the insert 30. Thus, the recess 20 and insert 30 produce a more forgiving and playable golf club.

Suitable materials for the high density insert include, but are not limited to, powdered tungsten, a tungsten loaded polymer, and other powdered metal polymer combinations.

Table 2 shows a comparison of center of gravity locations and MOI's for a 6-iron having a tungsten-loaded polymer insert 30 to a similar club head formed completely of steel. Note that the measurements presented in Table 2 do not include any weights that may be added to the club head.

TABLE 2

| | 6-iron with Tungsten Loaded Polymer Top Line | 6-iron with Steel Top Line | 6-iron with Urethane Top Line |
|---|---|---|---|
| Head mass (g) | 256.7 | 256.7 | 256.7 |
| Top line mass (g) | 14.7 | 7.52 | 1.37 |
| Total mass (g) | 278.31 | 271.13 | 264.98 |
| $CG_Y$ (mm) | 38.68 | 39.04 | 39.04 |
| $CG_Z$ (mm) | 19.05 | 18.52 | 18.06 |
| $CG_X$ (mm) | 12.47 | 12.14 | 11.86 |
| $I_{ZZ}$ (g · cm$^2$) | 2740 | 2710 | 2684 |

$CG_X$, $CG_Y$, and $CG_Z$ are the x-, y-, and z-components of the center of gravity location, respectively. $I_{ZZ}$ is the moment of inertia about the center of gravity parallel to the z-axis. Preferably, the tungsten-loaded top line insert raises the vertical center of gravity by at least about 0.0254 mm when compared to a similar club with a steel top line. In one embodiment, the tungsten-loaded polymer top line insert raises the $CG_Z$ by about 0.508 mm or more, preferably about 0.533 mm or more, and even more preferably greater than about 0.635 mm. The moment of inertia $I_{ZZ}$ of the club head with a high density insert in the top line is at least about 1 percent greater than the moment of inertia $I_{ZZ}$ of a similar club head with a steel top line. In one embodiment, the $I_{ZZ}$ of a club head having a heavier insert than the body is increased by about 1.5 percent or more when compared to the $I_{ZZ}$ of a similar club head with a steel top line.

Furthermore, a club head with a heavier top line insert (such as a tungsten-loaded polymer insert) preferably has a $CG_Z$ of at least about 0.508 mm more than a similar club head with a lighter top line insert (such as a urethane insert). For example, the $CG_Z$ of a heavier insert club head may be at least about 0.635 mm more, preferably about 0.762 mm or more, and more preferably about 0.889 mm or more, than the $CG_Z$ of a lighter insert club head.

Likewise, a club head with a heavier top line insert (such as a tungsten-loaded polymer insert) preferably has a $I_{ZZ}$ that is at least about 2 percent more than the $I_{ZZ}$ of a similar club head with a lighter top line insert (such as a urethane insert). For example, the $I_{ZZ}$ of a heavier insert club head may be at least about 2.5 percent greater than the $I_{ZZ}$ of a lighter insert club head.

The hardness of the insert will vary depending on the particular material used to form the insert. In one embodiment, the insert has a hardness ranging from about 80 Shore A to about 50 Shore D. In another embodiment, the hardness of the insert ranges from about 20 Shore D to about 50 Shore D. In an alternate embodiment, the hardness of the insert is less than about 20 Shore D.

Figure 6:
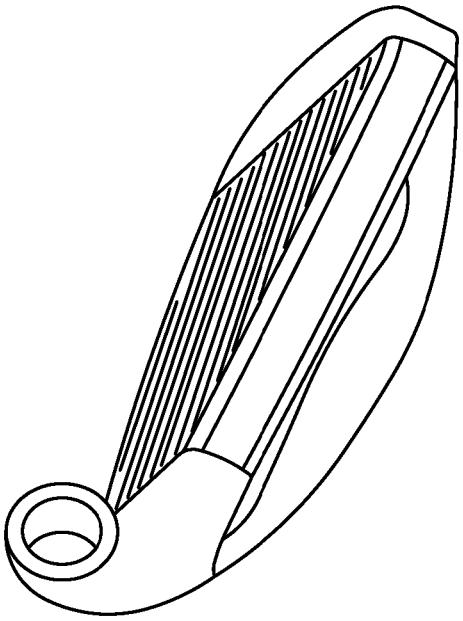
FIG. 6 shows a first isometric view of the golf club head of FIG. 1.
Figure 7:
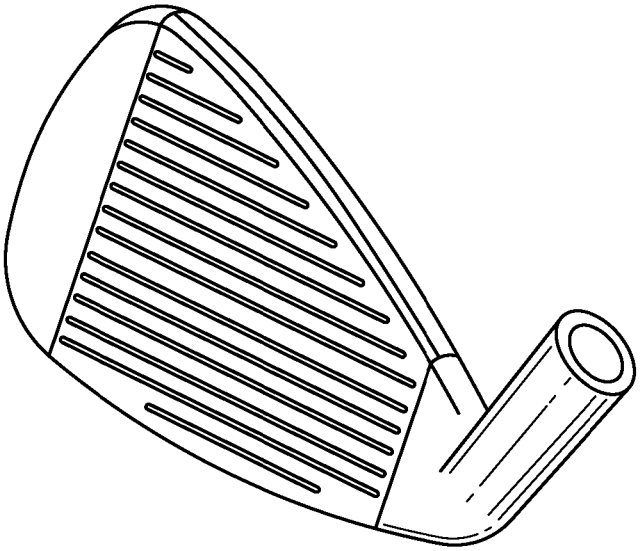
FIG. 7 shows a second isometric view of the golf club head of FIG. 1.

FIGS. 6 and 7 show isometric views of the golf club head 1.

The insert 30 may contain one or more dampening materials, which diminish vibrations in the club head, including vibrations generated during an off-center hit. Preferred dampening materials include those materials known as thermoplastic or thermoset polymers, such as rubber, urethane, polyurethane, butadiene, polybutadiene, silicone, and combinations thereof. Energy is transferred from the club to the ball during impact. Some energy, however, is lost due to vibration of the head caused by the impact. These vibrations produce undesirable sensations in both feel and sound to the user. Because the viscoelastic dampening material of the insert 30 is in direct contact with the metal club head (the vibrating body), it serves to dampen these vibrations, improving sound and feel.

In some embodiments, insert 30 may include a material that is non-Newtonian, elastic, pseudo-elastic, thixotropic, rheopectic, plastic, or super-elastic. Part or all of the insert may include a dilatant material, or shear-thickening, such as D3O or a thixotropic gel. Where the insert is housed within a recess to aid in hosel bending, the inclusion of a dilatant material may give additional strength and ball speed during play (i.e., the hosel is more bendable during fitting and stiffer during play). Shear thickening material is described in U.S. Pat. No. 8,105,184 to Lammer, the contents of which are incorporated by reference in their entirety.

Without being bound to any particular theory, a club with a high center of gravity is likely to impart more spin to the golf ball due to vertical gear effects. This is because an impact made below the center of gravity will increase the spin rate of the ball to help maximize trajectory and distance. An impact made high on the face above the center of gravity will create a higher launch angle, and the vertical gear effect will actually cause the ball to spin less. This can produce greater distance as the ball is subject to less lift or drag that a higher spin creates. Thus, in a typical club set, the higher the loft angle of the club, the lower the center of gravity (as compared to a lower loft angle club). The ability to generate more ball spin for the short irons is an important factor in the golfer's ability to control both the distance of the golf shot, and the distance the ball will roll after the ball hits the green.

However, because the material selection of insert, length, depth, and/or volume of the recess and insert of the present invention allow for adjustments to the center of gravity and moment of inertia, the present invention also contemplates a set of clubs where at least one club is equipped with a low density insert in the club head and at least one club is equipped with a higher density insert in the club head. For example, at least one long iron in the set preferably has a low density insert in the club head as described herein. The term "long irons" refers to 3 and 4 irons (and possibly 1 and 2 irons if application). The club heads on long irons have the least amount of angle, providing primarily distance. In contrast, at least one short iron in the set preferably has a high density insert in the club head. The term "short irons refers to any of the more lofted, shorter-shafted irons (usually considered to include the 8 iron through all wedges).

Due to vertical gear effects, this construction allows for more spin to be imparted to the ball from the short irons, and less spin imparted to the ball for the long irons. The ability to generate more spin in the short irons is an important factor in the golfer's ability to control both the distance of the golf shot and the distance the ball will roll after the ball hits the green.

Figure 8:
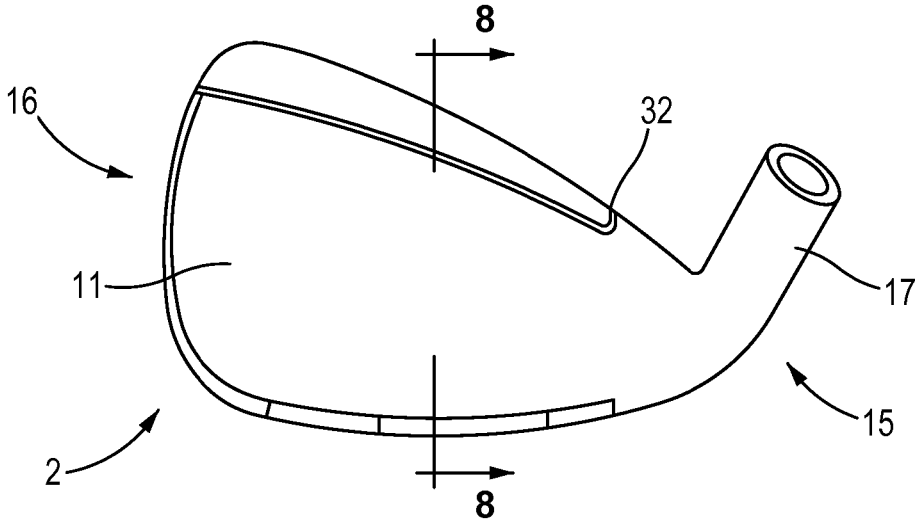
FIG. 8 shows another golf club head of the present invention.
Figure 9:
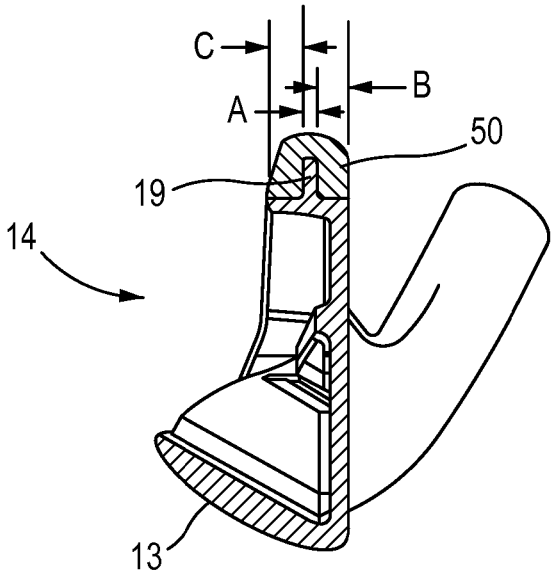
FIG. 9 shows a cross-sectional view of the golf club head of FIG. 8 taken along line 8-8.

FIG. 8 shows another exemplary golf club head 2 of the present invention and FIG. 9 shows a cross-sectional view of the golf club head 2 taken along line 8-8. In this embodiment, material is removed from the metallic club head at the top line 12. Instead of forming a recess at the top line 12, however, a thin protrusion 19 is provided. Metallic material has been removed from the top portion of the club head as described above, and a thin extension 19 is left in place. The insert 50 has a groove corresponding to the protrusion 19. Thus, the viscoelastic material can be fit onto the club head body 10. The insert 50 is attached to the casting, for example, through the use of an epoxy. A fixture with a cavity that matches the outer perimeter shape of the club head 1 should be used to hold the two pieces in place while the epoxy dries. A preferred width A for the protrusion 19 is 1.5 mm. This width ensures adequate structural integrity, though wider protrusions 19 may be used. For example, the width A may range from about 0.76 mm to about 2.54 mm. In one embodiment, the width A ranges from about 1.0 mm to about 2.0 mm. Preferred heights for the protrusion 19 include about 1.5 mm to about 6.4 mm, though other heights may be used. For example, the height of the protrusion may range from about 0.5 mm to about 13.0 mm.

Like the insert that fits within the recess, the insert 50 that fits over the protrusion 19 may be formed of a low density material in order to lower the center of gravity and/or MOI of the club head. In the alternative, the insert 50 may formed of a high density material in order to raise the center of gravity and/or MOI of the club head. The differences between the density of the insert and the body of the club head discussed above with respect to insert 30 also apply in this aspect of the invention.

It is possible that there are variations in size of the metallic portions of the club heads 1, 2 caused during forming and polishing. These variations typically are larger than the variations in size due to molding viscoelastic materials of the inserts 30. To aid in hiding any discrepancy between the two portions of the club head, a groove 32 may be formed in the insert 30 so the edges are visible to the user once the two pieces have been put together. This groove 32 may be created simultaneously with the rest of the insert 30, or as a secondary step. The preferred width and depth of the groove 32 are about 1 mm or less. In one embodiment, the width and depth are about 0.8 mm or less, preferably about 0.75 mm or less, and more preferably about 0.7 mm or less.

FIGS. 8 and 9 show an embodiment in which an insert is disposed on a mounting surface and providing part of the front surface for striking the golf ball. The mounting surface may be provided by a protrusion 19 extending upwards from the top portion when the club head is at address. FIG. 8 shows an embodiment in which the top line includes a protrusion 19 that provides the internal mounting surface, the protrusion 19 extending into the insert. In some embodiments, the mounting surface includes one or more micro-cavities accessible from a surface of the protrusion 19. As used herein, micro-cavity may be taken to mean any hollow, depression, or void on a surface, particularly one that is smaller than the cavity of a cavity-backed iron. Suitable micro-cavities are described in, and shown with particularity in FIGS. 23-29 of, U.S. Pub. 2012/0172147 to McDonnell, et al., the entire contents of which are hereby incorporated by reference for all purposes. In certain embodiments, the insert is co-molded with the club head and the material extends into the one or more micro-cavities.

FIGS. 8 and 9 depict a protrusion 19 formed in the center of the top line 12. Alternatively, the protrusion 19 can be formed towards or at the front of the top line 12 or towards or at the rear of the top line 12. The width B of the front portion of the insert 30 may be zero, meaning the protrusion 19 forms the top portion of the face 11. Alternatively, the width B may be, for example, about 0.7 to 6.35 mm. Similar to the width B, the width C of the rear portion of the insert 30 may be zero, meaning the protrusion 19 forms the top portion of the back 14. Alternatively, the width C may be, for example, about 0.7 to 6.4 mm. The height of the insert 30, measured along the longest portion thereof, preferably may be from 0.7 to 7.6 mm.

In certain embodiments, a surface of protrusion 19 functions as an internal mounting surface. Internal mounting surface may be taken to mean a surface of a part of a club head on which insert 30 is mounted such that the internal mounting surface is at least partially supporting, and therefore covered by, insert 30.

Use of an insert also has the added benefit of increasing the durability of the club head. For example, over the course of play, clubs carried together in a bag are knocked together. These impacts create marks on the club heads. The top-toe portion of the club is an area that is likely to impact with other clubs. By making that area out of a softer material, the likelihood of creating marks on the head due to club-to-club impacts is reduced.

Figure 10:
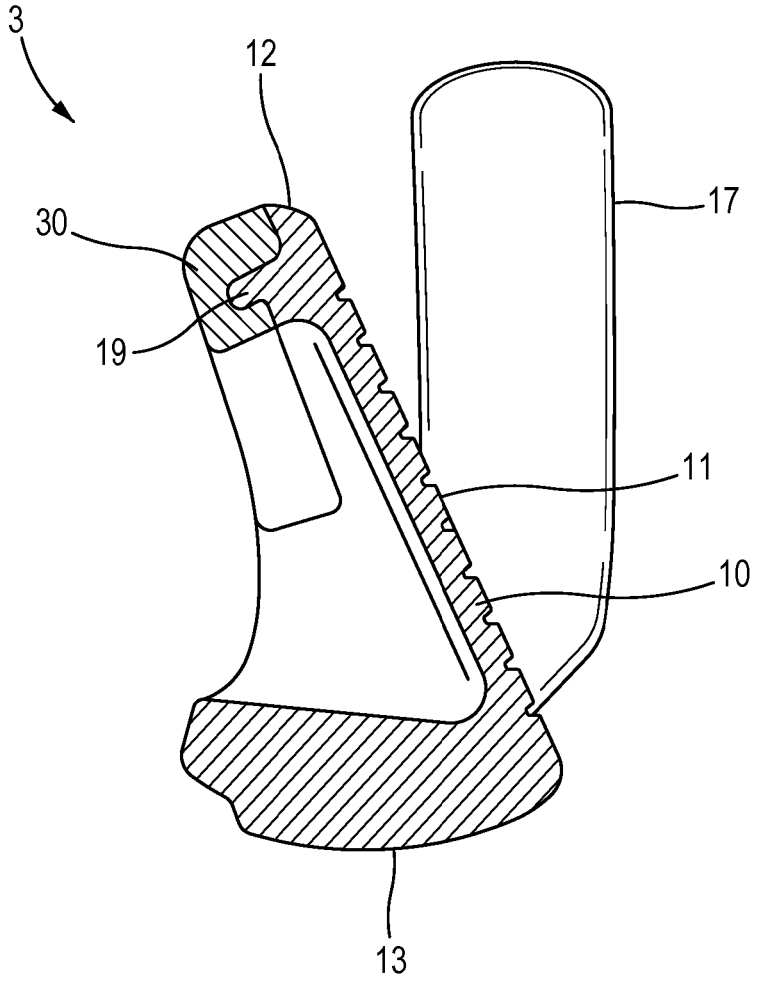
FIG. 10 shows a cross-sectional view of another golf club head of the present invention.
Figure 11:
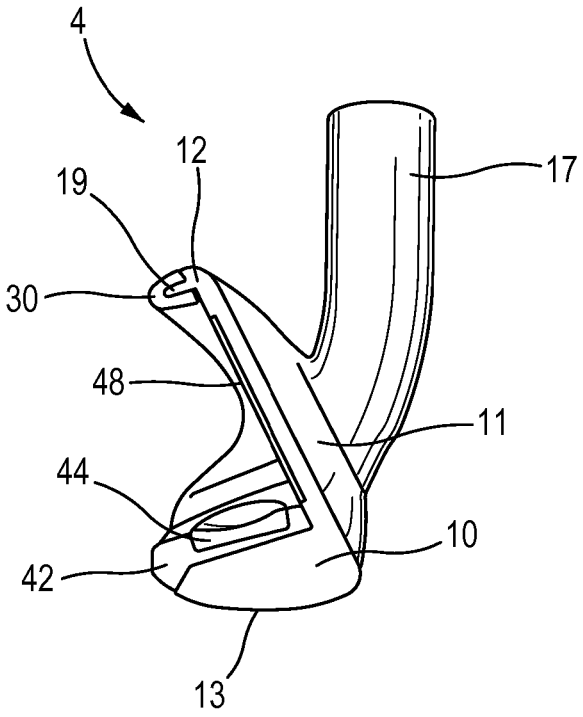
FIG. 11 shows a cross-sectional view of another golf club head of the present invention.
Figure 12:
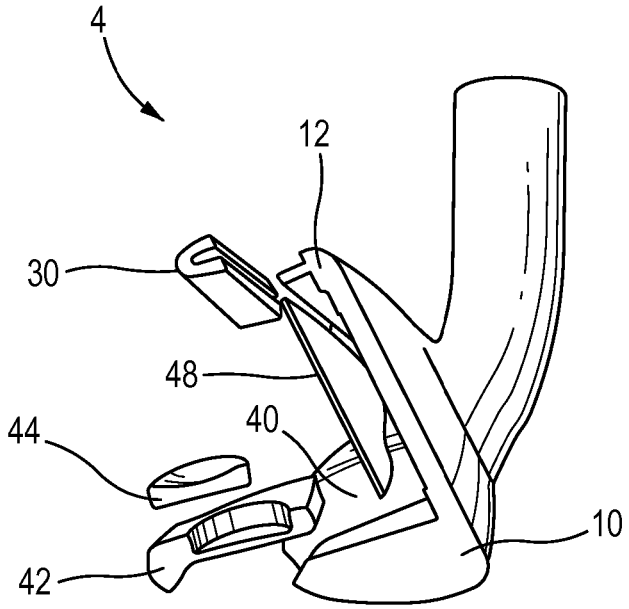
FIG. 12 shows an exploded view of the golf club head of FIG. 11.

FIG. 10 shows a cross-sectional view of another golf club head 3 of the present invention with the top portion removed. In this embodiment, metallic material has also been removed from the top line 12 and replaced with a light-weight viscoelastic insert 30. A protrusion 19 is also provided in this club head 3, but unlike the previously discussed club head 2, the protrusion is directed backward away from the face 11. The insert 30 contains a groove corresponding to the protrusion 19. Attachment is facilitated through the protrusion 19 and groove. The metallic face material extends to the upper most portion of the face 11 at the top line 12. Alternatively, the viscoelastic material may extend down the top portion of the face 11, for example, up to 7.6 mm. As shown in FIGS. 10-12, insert 30 may extend beneath the topline and into the cavity when the club is at address.

As before, the insert in this aspect of the invention may be a different material than a light weight viscoelastic material. For example, the insert may be formed of a higher density material in an effort to adjust the center of gravity upward and increase the $I_{ZZ}$.

FIG. 11 shows a cross-sectional view of another golf club head 4 of the present invention, and FIG. 12 shows an exploded view of the golf club head 4 and its individual components. In this embodiment, metallic material has also been removed from the top line 12 and replaced with an insert 30. FIG. 11 shows an insert disposed on an internal mounting surface and adjacent to a back surface of the face portion.

Similarly to the previously discussed embodiments, the insert 30 preferably is coupled to the club head 4 via a protrusion 19. In the illustrated embodiment, the protrusion 19 extends rearward from the body 10 near the top 12 of the club head 4, and the entire front surface 11 of the club head 4 is formed of a metallic material. Metallic mass is removed from the rearward side of the top 12 behind the front surface 11. Protrusion 19 provides an internal mounting surface for insert 30. Additionally, part of the internal mounting surface may be provided by a back surface of the face portion and insert 30 is disposed adjacent to the back surface of the face portion.

The protrusion 19 can be positioned at any desired location towards the top 12 of the club head 4. The insert 30 is formed of a material, such as nylon, having a high strength-to-weight ratio and a high impact strength-to-weight ratio. These properties ensure that the insert 30 provides a solid feel to the club head 4 while achieving the benefits, discussed above, of removing metallic material from the top line 12.

In this aspect of the invention, the insert material preferably has the following properties at 50% relative humidity and 73° F.; tensile strength of 15 kpsi to 20 kpsi, 17.5 kpsi being preferred; flexural modulus of 650 kpsi to 750 kpsi, 600 kpsi being preferred; notched impact strength of 3 ftlb/in to 4 ftlb/in, 3.5 ftlb/in being preferred; and specific gravity of 1.25 to 2, 1.4 being preferred. These properties and measurement methods are discussed in ASTM D 638, ASTM D 790, ASTM D 256, and ASTM D 792, respectively, which are incorporated herein by reference. One preferred material for the insert 30 of this embodiment is a 33% glass reinforced nylon 66. An insert may include a nylon such as the nylon material sold under the name ZYTEL 74G33L NC 010 by E. I. du Pont de Nemours and Company (Wilmington, Del.). This product meets the preferred physical properties and allows the club designer to provide a top line 12 with a surface finish similar to that of an all steel club head, which may be beneficial to some golfers. More or less glass reinforcement may be used. In particular, while 25 percent to 50 percent is a preferred range for glass (including fiberglass) reinforcement in the nylon material of the insert 30, other amounts may be used. In addition, other reinforcing materials other than glass may also be used.

The club head 4 of FIG. 11 further includes a recess 40 in the upper portion of the sole 13 between the heel 15 and the toe 16. By this recess 40, additional metallic material is removed from the central portion of the club head, further biasing mass towards the club head perimeter and allowing mass to be redistributed to more beneficial locations of the club head 4. The recess 40 may extend completely through the sole 13, or only partially into the sole 13. A second insert 42, preferably formed of a viscoelastic material, may be included within the recess 40. This insert 42 provides a filled-in look to the club head 4, and may further reduce or eliminate unwanted vibrations. A medallion 44 or other weight member may be included in the second insert 42. Inclusion of a weight member 44 coupled to the insert 42 opposite the body 10 of the club head 4 creates a constrained-layer damping system to dissipate unwanted vibrations generated during use of the golf club. The insert 42 and weight member 44 are coupled in known fashion, such as through use of an adhesive. Mechanical fasteners may also be used, alone or in conjunction with an adhesive. The insert 42 may include a recess in which the weight member 44 is attached, providing a smooth transition between the insert 42 and the weight member 44.

A third insert 48 may also be included with the club head 4. This third insert 48 preferably is coupled to the back 14 of the club head 4, opposite the front surface 11. The insert 48 preferably is formed of a viscoelastic material, and thus it damps unwanted vibrations via free-layer damping. The insert 48 may be coupled to the club head 4 in any known manner, such as via an adhesive. The insert 48, as well as the other inserts described herein, may also inherently possess adhesive properties such that it may couple directly to the club head without the need of a separate adhesive material.

Figure 13:
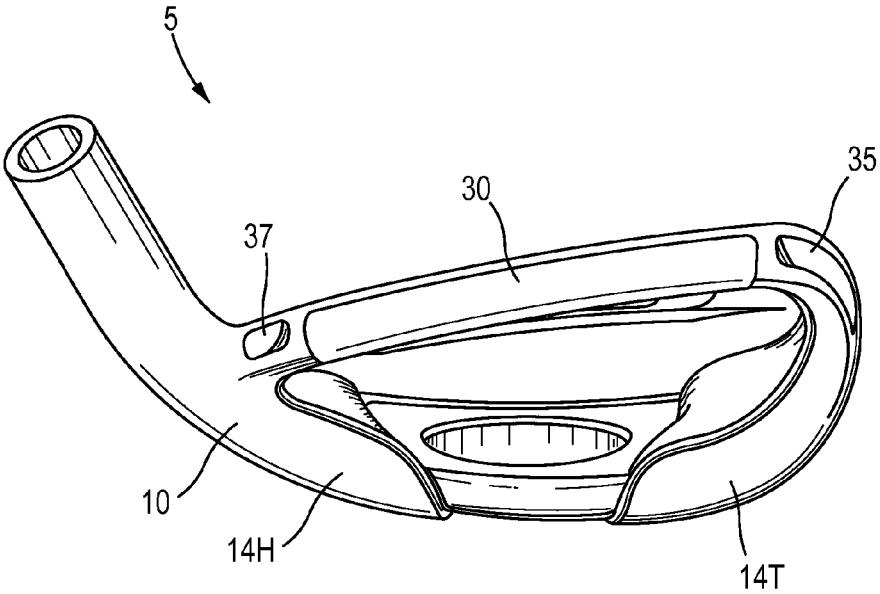
FIG. 13 shows a top, rear view of a golf club head of the present invention.

In addition to removing mass from the central portion of the top line 12, additional material, and therefore mass, may be removed from heel and toe portions of the top line 12. FIG. 13 shows a top, rear view of a golf club head 5 of the present invention. The club head 5 illustrated here shows a central top line insert 30 made of a light weight material as described above, for example a polymer such as polyurethane or a nylon, that replaces metal material that is traditionally located in this portion of the club head. In addition, the club head body 10 illustrated in FIG. 13 defines a recess in the upper toe portion of the club head into which a light weight insert 35 is positioned. Preferably, this recess stretches around the top-line—toe transition, shown in the illustrated club head as being a curved transition. Alternatively, toe insert 35 may be positioned such that it is located intermediate the top line and the sole of the club, allowing for toe insert 35 to be hidden from the golfer's view when the club is at address position. Additionally, the club head body 10 illustrated in FIG. 12 defines a recess in the upper heel portion of the club head into which a light weight insert 37 is also positioned. The toe and heel recesses preferably extend completely through the top line 12 to the cavity (assuming here that a cavity back club head is used), but may extend only partially through the club head body 10.

Figure 14:
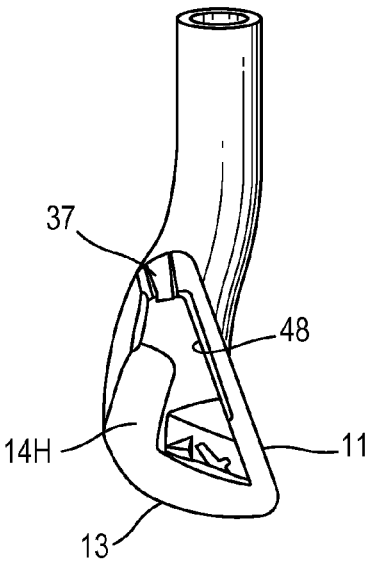
FIG. 14 shows a cross-sectional view through a heel section of the golf club head of FIG. 13.
Figure 15:
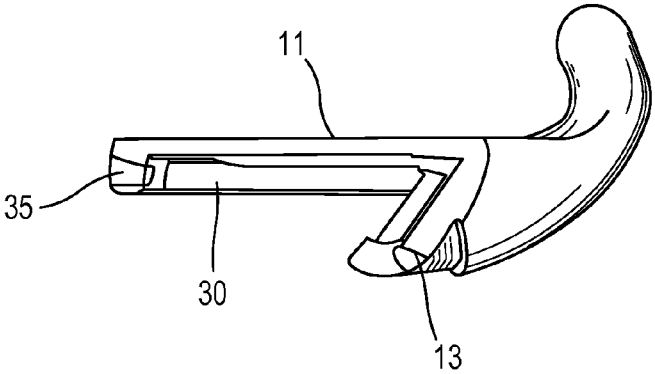
FIG. 15 shows an angled cross-sectional view through the club head of FIG. 14, extending from a mid-sole area to the top line.

FIGS. 13-15 show an exemplary club head 5 in which the toe top line recess preferably is larger than the heel top line recess. This may provide benefits, such as making the club head 5 easier to turn over, or close, during the golf swing. For example, the toe top line recess volume may be from about 1 to about 5 times the heel top line recess volume. Preferably, the central top line recess volume is greater than the toe top line recess volume. The toe and heel inserts 35, 37 may be formed of the same material as the central insert 30, or they may be different. For example, the central insert 30 may be formed of a viscoelastic material to damp vibrations generated during normal use of the resulting golf club, and the toe and heel inserts 35, 37 may be formed of a material that is lighter than the central insert material. Additionally, the toe and heel inserts 35, 37 may be formed of the same material or differing materials.

These toe and heel top line recesses work in conjunction with the central top line recess to remove unneeded club head mass from the upper portion of the club head, which may be repositioned as added mass or weight members in other, more beneficial locations of the club head while keeping the overall club head mass and weight constant. For example, mass may be added to heel and toe portions of the sole, such as by including additional material forming the club head body 10 or by incorporating weight inserts. This beneficially further lowers the club head center of gravity, making the resulting golf club easier to use. Furthermore, repositioning of the "saved" mass and weight to toe and heel portions of the club head further increase the club head MOI, making the club head more stable and forgiving, also increasing the playability of the resulting golf club.

FIG. 14 shows a cross-sectional view through a heel section of the golf club head 5. Weight and mass saved through the use of the heel recess insert 37 has been repositioned into the rear heel portion 14H of the club head 5. Similarly, FIG. 15 shows an angled cross-sectional view through the club head 5, extending from a mid-sole area to the top line 12, substantially perpendicular to and through the center of the toe recess insert 35. As best shown in FIG. 13, the weight and mass saved through inclusion of the toe insert 35 has been repositioned into the rear toe portion 14T of the club head 5. The weighting of the low heel and toe portions may be increased by increasing the height these club head portions extend above the sole 13. Another way the weighting of these portions can be increased is by incorporation of weight inserts in the club head body 10.

Figure 16:
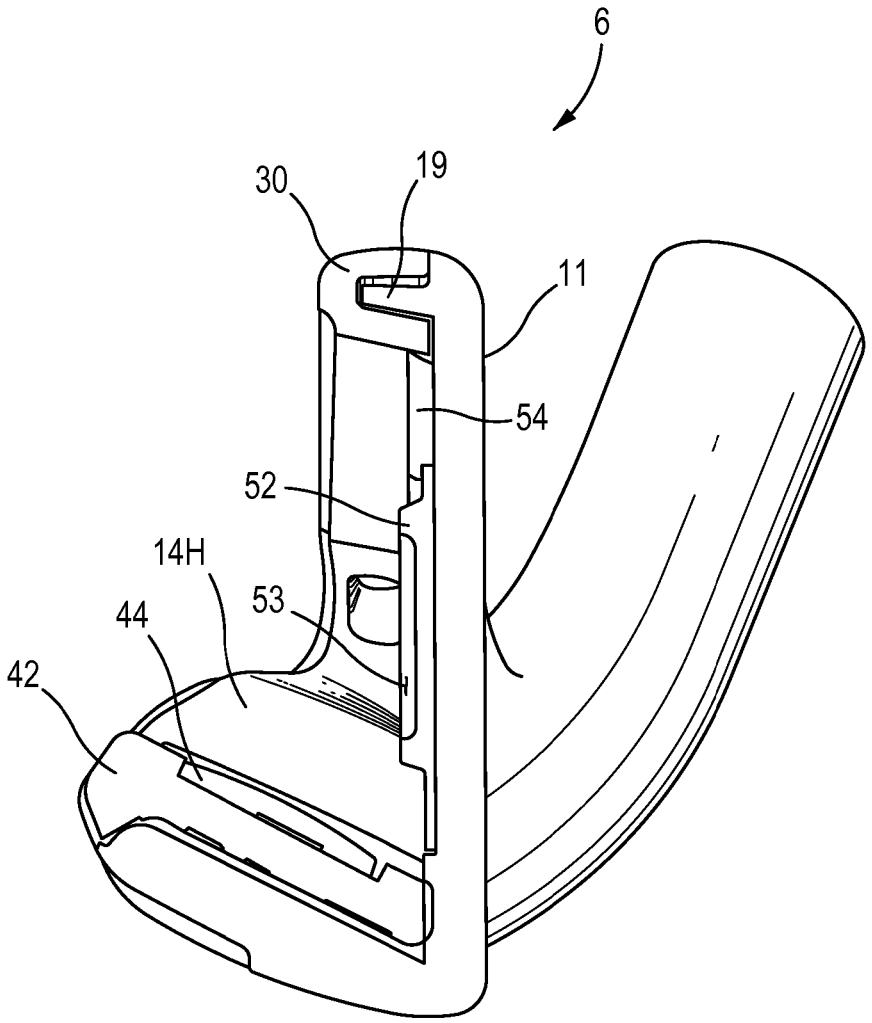
FIG. 16 shows a heel cross-sectional view of a golf club head of the present invention.

FIG. 16 shows a heel cross-sectional view of a golf club head 6 of the present invention. Here, club head 6 includes a protrusion 19 that provides a portion of an internal mounting surface. Insert 30 may be disposed on an internal mounting surface and adjacent to a back surface of the face portion. A portion of the internal mounting surface is provided by a back surface of the face portion and insert 30 is disposed adjacent to the back surface of the face portion. This illustrated club head 6 is similar to the club head 4 illustrated in FIGS. 11 and 12. However, instead of a one-piece insert on the rear surface of the face wall, this club head 6 uses a two-piece insert. A first rear insert 52 is positioned on a lower portion of the rear wall surface, adjacent the insert 42 positioned atop the sole wall. This first rear insert 52 may be formed of a vibration damping material as discussed above with respect to the third insert 48. An additional insert may be included within a pocket 53 defined by a rear surface of the first rear insert 52, which additional insert preferably may be a medallion as described above with respect to the medallion 44 illustrated in FIGS. 11 and 12. In this case, both the first rear insert assembly (first rear insert 52 and its medallion insert) and the sole wall insert assembly (insert 44 and medallion 44) are mass-spring damping systems. Alternatively, the first rear insert 52 itself is a medallion. As shown in FIG. 16, a ridge may be formed in the lower portion of the rear wall surface adjacent the sole wall, extending rearward therefrom, upon which the first rear insert 52 may rest.

In addition to the first rear insert 52, the club head 6 further includes a second rear insert 54. This insert 54 is positioned atop the first insert 52, and includes a notch at its lower end to contact and overlap the first insert 52. As shown in FIG. 16, the notch provides for contact between the rear inserts 52, 54 along two, substantially perpendicular surfaces. Additionally, the second rear insert 54 further includes a tapered top surface. The second insert beneficially may be shaped and dimensioned such that it is longer than the distance from the rear wall ridge to the central top line insert 30. Formed of a viscoelastic material, the tapered upper surface of the second rear insert 54 can be deformed such that it is retained in a state of compression adjacent the rear wall surface. This compressive force is transmitted to the first rear insert 52, helping retain the first and second rear inserts 52, 54 in position. Thus, the rear surface inserts preferably are subjected to and retained in a substantially vertical (that is, in a sole-to-top line direction) compression force. In other words, the second rear insert 54 exerts a downward force upon said first rear insert 52. Retaining the inserts 52, 54 in a state of compression also alleviates any gaps that might otherwise be present due to variances in manufacturing of the club head parts and tolerances. In addition to this compressive force, the inserts 52, 54 may also be coupled, such as through use of an adhesive such as an epoxy, to the rear wall surface as illustrated.

Figure 17:
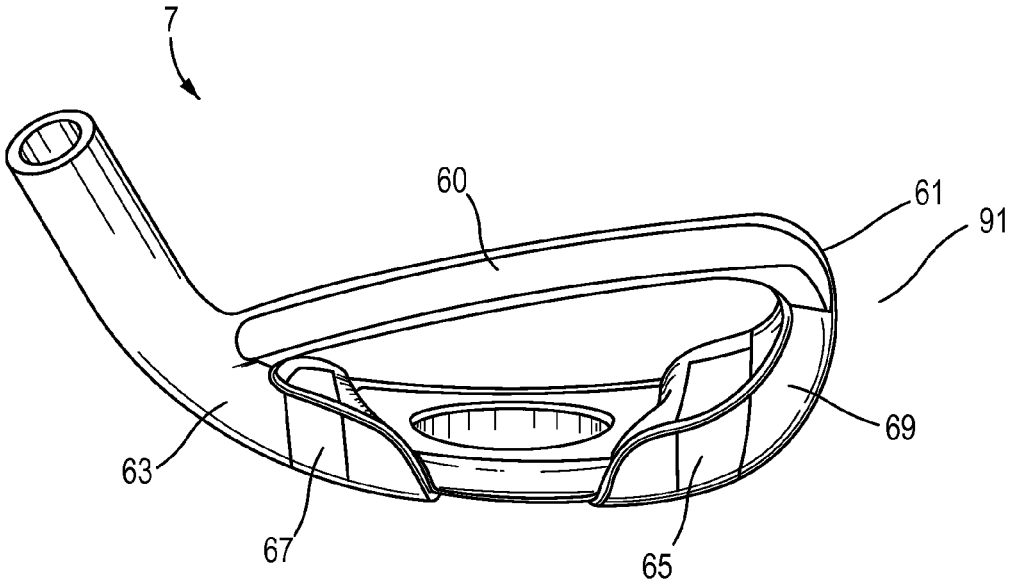
FIG. 17 shows a top, rear view of a golf club head according to an embodiment of the present invention.

FIG. 17 further illustrates a club head of the invention where the recess in the top line extends from the heel portion 63 of the top line around the toe 61. In some embodiment, both the recess and insert 30 extend from a heel-ward area, around a top line—toe transition, and into a toe-side surface. The recess may be of varying or constant depth and volume with the ranges previously discussed. In one embodiment, the depth of the recess varies in at least two portions of the recess by about 10 percent or more. For example, one section of the recess may be about 0.25 mm deep and another section of the recess may be as much as 6.4 mm deep. In another embodiment, the depth of the recess is greater along the length of the top line than at the top-line—toe transition. In addition, in this aspect of the invention, the recess may be filled with an insert 60 to reduce or increase mass at the top line depending on the desired center of gravity and moment of inertia as previously described.

FIG. 17 also demonstrates the use of high density weight inserts in other portions of the club head. For example, weight inserts 65 and 67 are located in recesses in the toe and heel portions of the sole. The weight inserts may be positioned in both the toe 65 and the heel 67 portions of the sole to increase the moment of inertia of the club head and lower the center of gravity. The weight inserts 65 and 67 are preferably made of a high specific gravity material, such as tungsten. The weight inserts 65 and 67 preferably have a specific gravity of at least about 7, and preferably greater than about 9. Ideally, the specific gravity of the weight inserts 65 and 67 are greater than the specific gravity of the club head body 69 by at least about 4, and preferably at least about 5.

Figure 18:
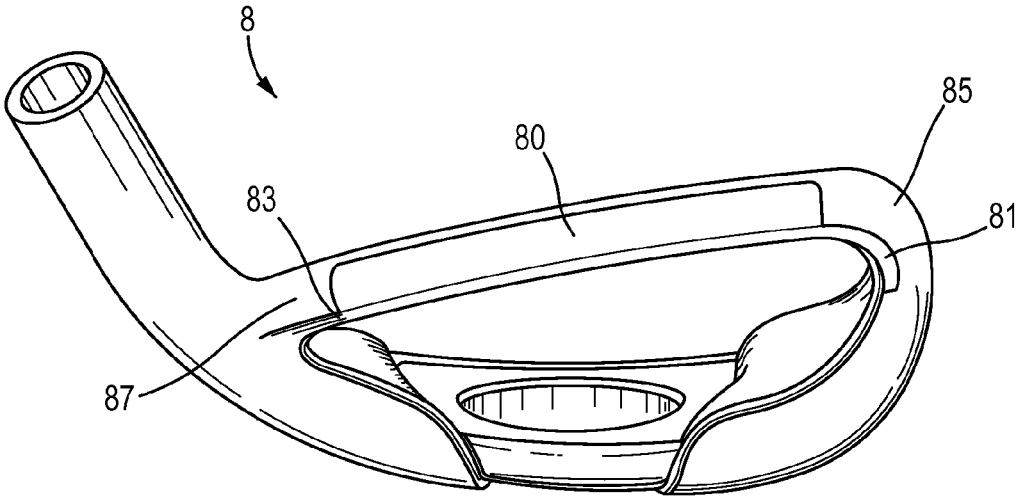
FIG. 18 shows a top, rear view of a golf club head according to an embodiment of the present invention.

In another embodiment of the invention as seen in FIG. 18, a portion of the top line insert 80 is positioned underneath the top line and extends down into the cavity of the club. In particular, the portions of the top line insert 80 that are located under the top line are in the heel 83 and toe 81 sections of the top line. The insert 80 may extend from the heel 83 around the toe 81. However, the only section of the insert 80 that is visible to the golfer when the club is at the address position is the central portion between the heel 87 and the toe 85. The advantage of positioning a portion of the top line insert below the top line is the ease of which the lie and loft may be adjusted. Typically, the lie and loft are adjusted using a device that clamps down on the top line. By setting some of the insert below the metallic top line, regardless of whether a low density or high density insert is employed, the clamp will not damage or disfigure the top line.

Any of the inserts discussed herein including, but not limited to, inserts 30, 35, 37, 50, 60, 65, 67, and 80 may be retained within the respective recesses in known manner, such as through use of an adhesive or epoxy. Alternatively, the inserts of the invention may be molded in place, known as "co-molding." To ensure a smooth top line surface along the entire length of the top line, the top line, with the inserts in place, may be polished. This may be performed, for example, through wet sanding or grinding, which facilitates simultaneous removal of both metallic and polymer/nylon materials. Preferably, the toe and heel recesses are spaced from the central recess by portions of the club head body. This helps ensure that structural integrity of the club head is retained. The insert(s) may also be held in place by utilizing the protrusion configurations generally shown in FIGS. 9, 10-12, and 16.

As previously described, the golf club head of the present invention has a moment of inertia $I_{ZZ}$ about an axis that passes through the center of gravity and is parallel to the z-axis (as shown in FIG. 2). This axis of rotation relates to the forgiveness of an iron in the heel to toe rotation about the center of gravity. Thus, a higher $I_{ZZ}$ indicates a greater resistance to twisting on off-center hits, resulting in more forgiveness. As shown in the data in Tables 1 and 2 above, regardless of whether a low density or high density insert is employed, the $I_{ZZ}$ for the present invention is preferably greater than about 2500 g·cm$^2$.

In addition, the moment of inertia $I_{ZZ}$ for a club head of the present invention may be related to the vertical center of gravity ($CG_Z$) by the following equation:

$$I_{ZZ} \geq CG_Z \times 170$$

where $I_{ZZ}$ is in g·cm$^2$ and $CG_Z$ is measured in millimeters (mm) in the z-direction.

In one embodiment, the club head satisfies the following relationship between the specific gravity of a low density, light weight top line insert, the moment of inertia $I_{ZZ}$, and the center of gravity $CG_Z$:

$$I_{ZZ} \geq CG_Z \times SG \times 130$$

where specific gravity of the insert is SG, $I_{ZZ}$ is greater than 2500 and is in g·cm$^2$, and $CG_Z$ is measured in millimeters (mm) in the z-direction.

In another embodiment, the club head satisfies the following relationship between the specific gravity of a high density, heavy weight top line insert, the moment of inertia $I_{ZZ}$, and the center of gravity $CG_Z$:

$$I_{ZZ} \geq CG_Z \times SG \times 17$$

where specific gravity of the insert is SG, $I_{ZZ}$ is greater than 2500 and is in g·cm$^2$, and $CG_Z$ is measured in millimeters (mm) in the z-direction.

A set of club heads including at least one club head with a low density (light weight) and at least one club head with a high density (heavy weight) insert will preferably have clubs in the set that meet the relationship of all three equations.

As discussed above, FIGS. 13 and 16-18 show iron-type golf club heads in which an insert is disposed adjacent to a back surface of the face portion. In some embodiments, insert 30 extends down a back surface of the face.

Figure 19:
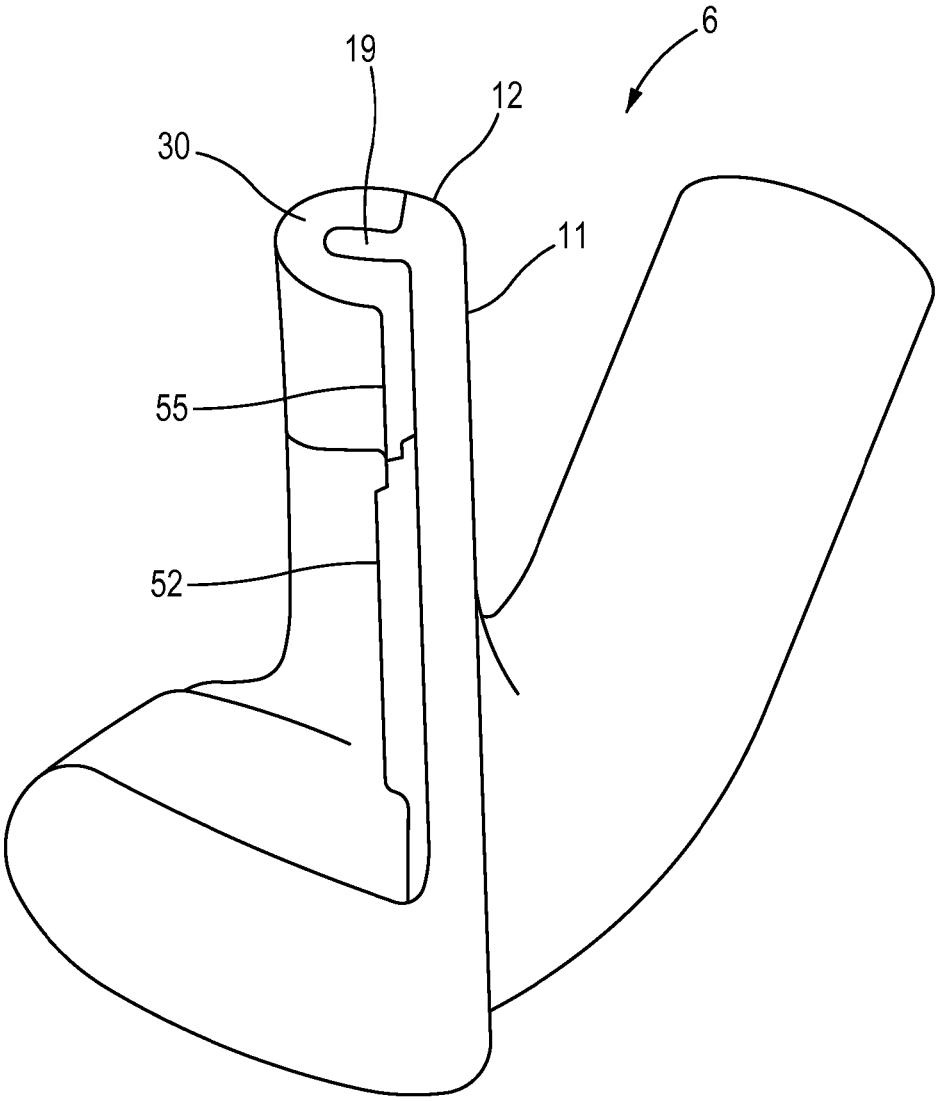
FIG. 19 shows an insert disposed on an internal mounting surface provided by a protrusion and a back surface of a face.

FIG. 19 shows an insert 30 having an extension portion 55 that extends down the back surface of the face 11. The top portion may optionally include a protrusion 19 extending into insert 30. Protrusion 19 and a back of face 11 each provide at least a portion of an internal mounting surface. Any internal mounting surface may include one or more micro-cavities accessible from a surface of the protrusion 19. Cavities can be taken to mean any deviation from planar such as pockets, hollows, or recesses that add texture to improve a gripping strength of adhesion between a mounting surface and insert 30.

Aspects of the invention include the insight that club head mass distribution can be improved by extending a dimension of insert 30. In some embodiments, insert 30 extends across a top line of a club head in a heel-ward direction and through a hosel area. Additionally, a recess in hosel 17 aids bending while allowing hosel material to gently redistribute during bending without straining the material. Insert 30 provides a smooth finish on the hosel side surface of the club head body so that the recess does not interfere with aerodynamics or trap dirt from the environment. Bendability in club heads is discussed in U.S. Pat. No. 6,186,903 to Beebe and U.S. Pub. 2012/0115632 to Cackett, the contents of each of which is incorporated by reference.

Figure 20A:
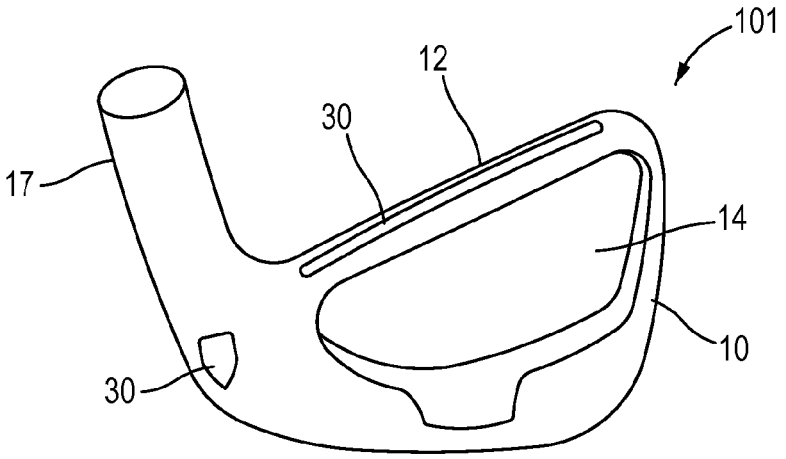
FIGS. 20A-20C show an iron-type golf club head with a recess that extends through the hosel.
Figure 20B:
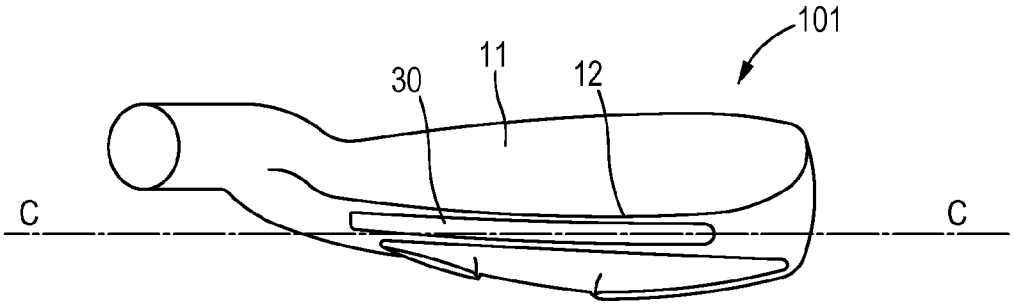
Figure 20C:
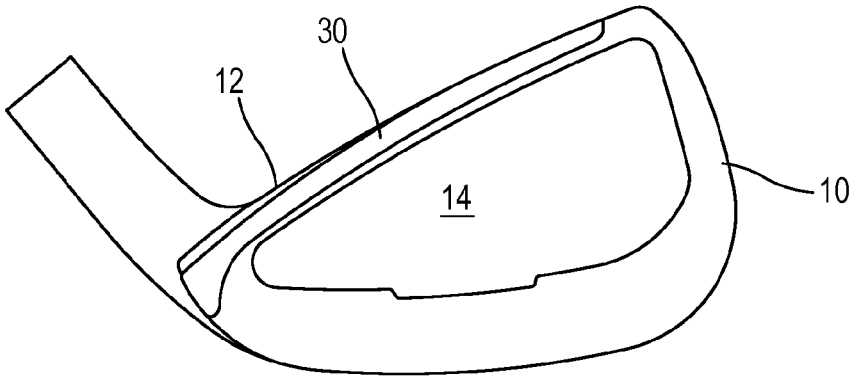

FIGS. 20A-20C show an iron-type golf club head 101 that includes a face 11 with a front surface for striking a golf ball. Club head 101 has a body 10 supporting the face 11 and comprising a heel, a sole, a toe, and a top line 12 wherein the top line 12 comprises at least two internal surfaces facing inward to define a recess, wherein the recess extends through the hosel and is accessible from a heel-side surface of the club head and at least a portion of the recess is accessible from above when the club head is at address. Hosel 17 extends from the body portion; and an insert 30 is disposed within the recess and visible on the heel side surface and from above when the club is at address. As shown particularly in the cutaway view in FIG. 20C, taken along line CC in FIG. 20B, insert 30 extends through the hosel to be visible on a hosel-side surface of club head 101.

In some embodiments as depicted for example in FIG. 20C, top line 12 supports insert 30 by extending under it, forming a cup-shaped or U shaped cross section, which cradles insert 30. In certain embodiments, top line 12 is spaced away from a back surface 14 of striking face 11 and insert 30 is mounted against the surface 14.

Figure 21A:
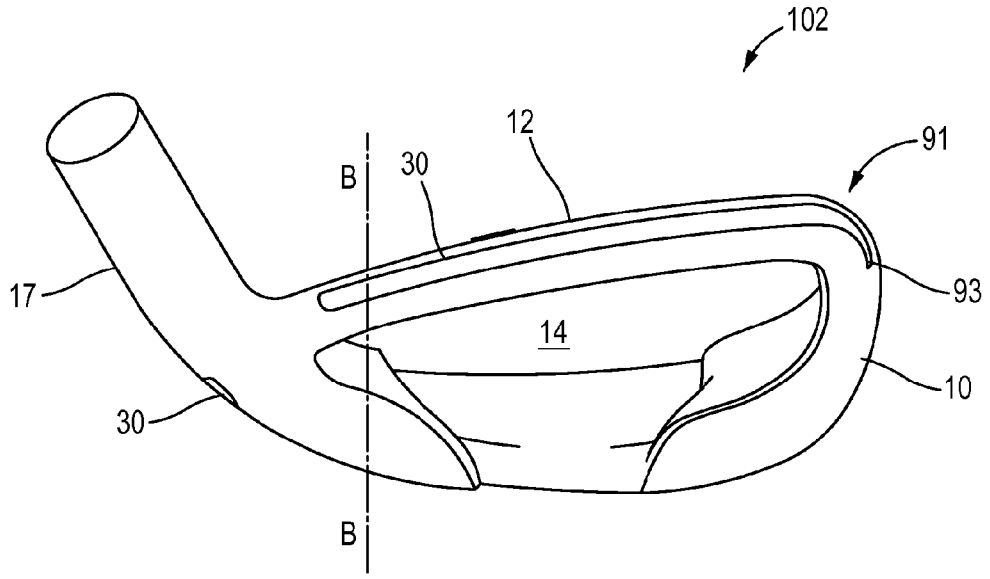
FIGS. 21A and 21B illustrate a club head with an insert is disposed adjacent to the back surface of the face.
Figure 21B:
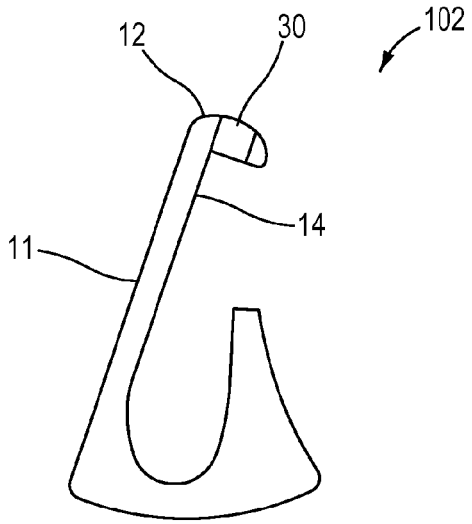

FIGS. 21A and 21B illustrate an embodiment in which a club head 102 has a body 10 supporting the face 11 and comprising a heel, a sole, a toe, and a top line 12 wherein the top line 12 comprises at least two internal surfaces facing inward to define a recess, wherein the recess extends through hosel 17 and is accessible from a heel-side surface of the club head and at least a portion of the recess is accessible from above when the club head is at address, wherein one of the two internal surfaces is provided by a back surface of the face 11 and the insert is disposed adjacent to the back surface of the face 11. As shown in FIG. 21A (as well as in FIG. 17), the recess and insert 30 or insert 60 can extend along top line 12, around a top line—toe transition 91, and into a toe-side surface.

Figure 22:
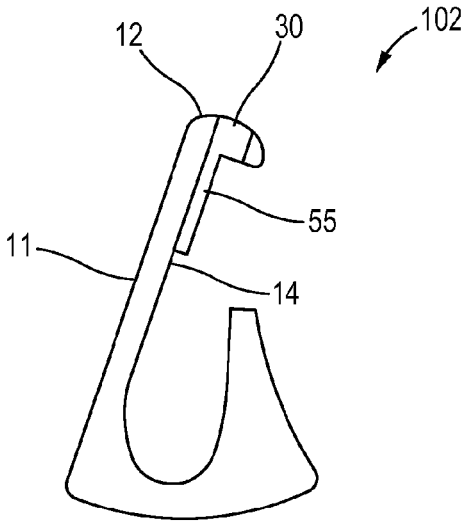
FIG. 22 illustrates an insert that includes an extension portion that extends along a back of a striking face.

FIG. 22 depicts an embodiment in which insert 30 extends down the back surface of the face portion lower than the topline.

Insert 30 may be translucent or clear. Providing a translucent or clear insert may provide useful benefits by revealing a portion of material that is otherwise covered by insert 30. For example, with reference to FIG. 19, if face portion 11 had a crack or other visible fatigue extending across the back of the metal, if insert 30 were translucent or clear, a golfer could see the fatigued material and know to replace the club.

Insert 30 may be interchangeable by a golfer. Insert 30 can be held in place by a press-fit, or an adhesive that is easy to peel off, or by other means, such that a golfer can remove one and replace it. This provides a benefit as a metal component of a club head may have very long longevity while insert 30 may weather or face in the sun after a period.

Insert 30 may be moveable (i.e., repositionable) or removable (i.e., interchangeable) also to provide a benefit in club fitting. When a club head is prepared for a golfer according to the golfer's specifications, it is clamped in a vise in a fitting station machine, a cheater bar is slipped over the shaft (or a shop shaft used for bending), and the hosel is bent until the final shape is obtained. In some embodiments, it may be preferable for the vise to only contact the material (e.g., metal) of the club head body. In such a case, it may be desirable to remove the insert for fitting or even to not have yet added an insert. In certain embodiments, for example where a club head has a delicate finish, it may be desirable to place an oversized dummy insert into the recess and clamp the head into the vise such that the jaws of the vise grip the dummy insert and do not make contact with the club head body. If the insert is interchangeable, this benefit can be obtained if the club is refit in a fitting station machine even after being sold to the customer, used, and brought back to the fitting station.

In certain embodiments, a club head comes with a set of interchangeable inserts and a golfer can use the insert of his preference. This is beneficial due to the properties of insert 30. In all embodiments, insert 30 may provide good vibration-dampening benefits to a club head. Where a club head comes with a plurality of insert 30, each of the plurality may have a different elastic modulus. A golfer can chose the insert 30 that provides the requisite amount of vibration-dampening and insert it into the club head (e.g., to be mounted there by press-fit, golfer-applied adhesive, or other means).

Insert 30 may be co-molded with the club head. Co-molding may refer to the use of two separate molds on a club head or may be taken to include a one or more applications of a molding process with multiple materials or components, combining the materials or components to provide a unitary piece. See, e.g., U.S. Pat. No. 7,922,604.

A mounting surface of the club head for contact with insert 30 may include micro-cavities for good adhesion. A material of insert 30 may extend into the micro-cavities, particularly when co-molded.

FIGS. 21A and 21B show a club head 102 having a face portion with a front surface for striking a golf ball and a body portion supporting the face portion and comprising a heel, a sole, a toe, and a top line. Club head 102 includes insert 30, which may include a material with a density lower than a density of the club head. Preferably, insert 30 is disposed adjacent to a back surface 14 of the face portion 11.

As shown in FIGS. 3, 21B and 22, the internal surfaces can include a substantially aft-facing surface 97 and a substantially fore-facing surface 98. In certain embodiments, as depicted in FIGS. 21B and 22, the fore and aft-facing surfaces are not connected by a floor surface along a portion or all of a top area of the club head. Insert 30 may be held in place by adhesive, press-fit, or other means. This construction is to provide optimized vibration dampening while also providing a low club head center of gravity.

In some embodiments, such as in FIGS. 3 and 20, a floor surface 99 may extend between substantially aft-facing surface 97 and a substantially fore-facing surface 98. Floor surface 99 preferably at least partially faces upwards when the club is at address. A cross section of the recess may be "squared off" as shown in FIG. 3, such that any or all of substantially aft-facing surface 97, substantially fore-facing surface 98, and floor surface 99 are substantially planar. The cross section may have a shape like a U or V. In the squared off or U shaped configurations, aft-facing surface 97 and fore-facing surface 98 are substantially parallel to, and facing, each other.

As shown in FIG. 21A, the recess extends from a heel-ward portion of the top line, around a top line—toe transition 91, to a toe-side terminus 93 in a toe-side surface of the club head. Insert 30 may extend from a heel-ward terminus of the recess, around the top line—toe transition, and into the toe-side terminus 93 in the toe-side surface of the club head.

FIG. 22 illustrates an embodiment in which insert 30 includes an extension portion 55 and recess 30 extends along a back 14 of striking face 11.

FIGS. 23A-25 show an iron-type golf club head 103 in which a substantial portion of face 11 has a first material (the same or different from a material of body 10). Face 11 also has a second material provided by insert 30. Preferably, the first material is denser than the second material. Body 10 supports face 11 and includes a heel, a sole, a toe, and a top line together defining a cavity in a back side of the club head. Top line 12 has a top internal surface 93 defining a recess in the top line and a heel-area internal surface 93 defining a recess in the heel area. At least a portion of the recess is accessible from above when the club head is at address, as shown in FIG. 23B. Insert 30 is disposed within the recess and provides a part of the front surface 11 for striking the golf ball. In certain embodiments, internal surface 93 faces forward when the club head is at address.

Figure 23A:
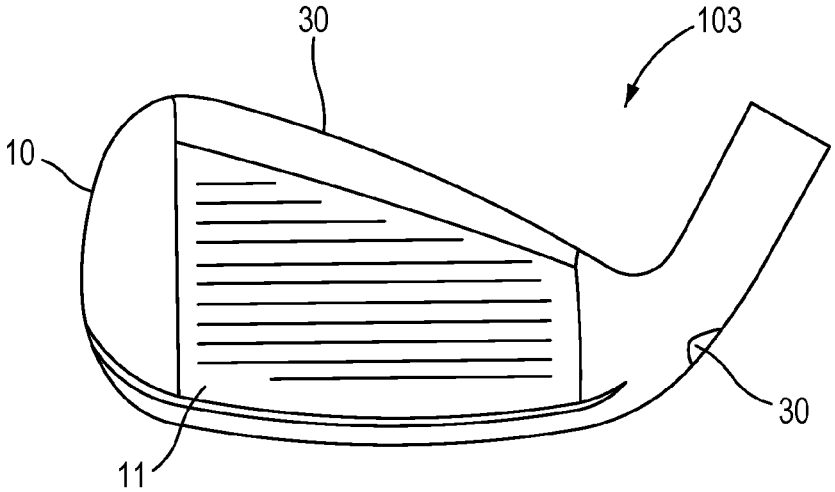
FIGS. 23A-23B show a club head in which part of the striking face is provided by an insert.
Figure 23B:
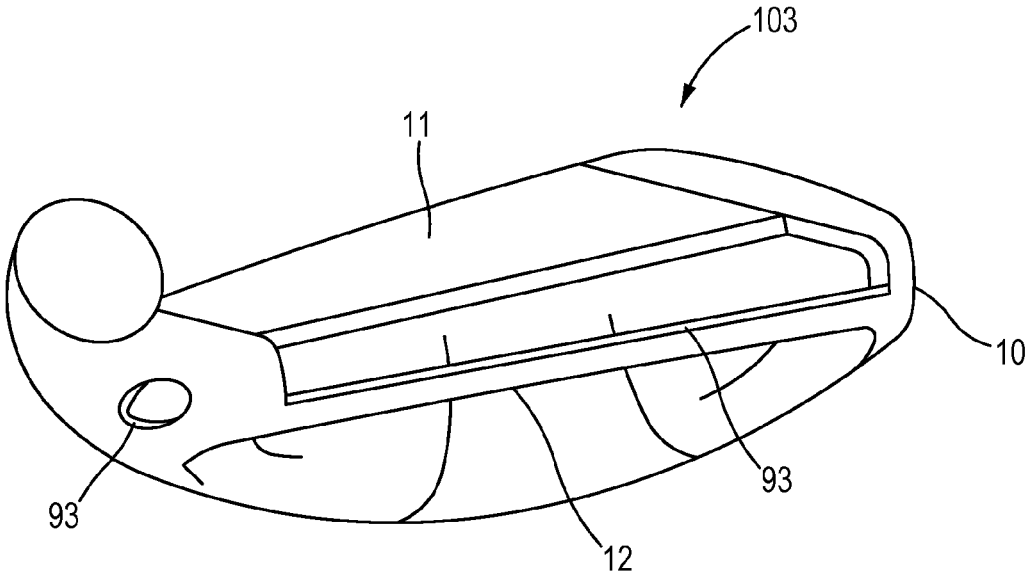

As shown in FIG. 23A, the recess extends through the hosel and is accessible from a heel-side surface of the club head and the insert is visible on the heel side surface.

A vertical dimension of insert 30 can be greater than a vertical dimension of topline 12 such that if they are close to being aligned to one another across the top of club head 103, then insert 30 extends beneath top line 12 and into the cavity when the club is at address (see also FIGS. 19 and 22). In some embodiments, the recesses extends from the heel around the top line—toe transition. In certain embodiments, the recess, insert 30, or both have a heel-toe width substantially similar to that of face portion 11.

Figure 24A:
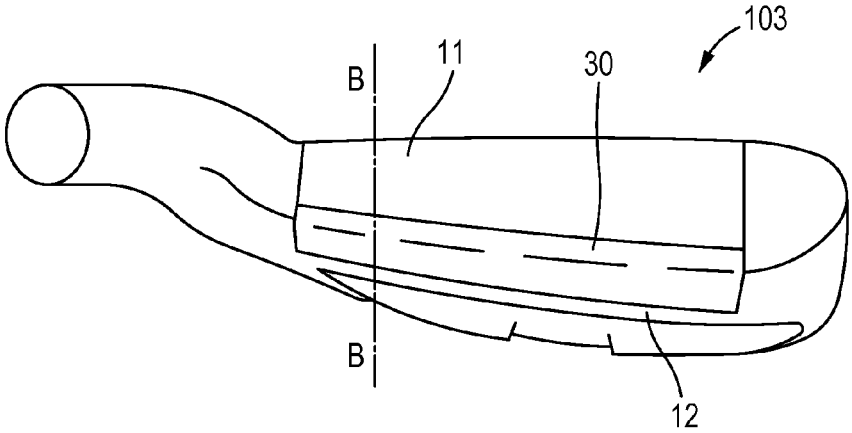
FIGS. 24A-24B show a club head in which part of the striking face is provided by an insert.

FIG. 24A gives a top view of club head 103. It can be seen that a portion of insert 30 and top line 12 cooperate to a define a top area of club head 103. It may be preferable to have a portion of top line 12 at a top of the club head for protecting the club head when it is inserted into, and gripped by, the bending station equipment used to set loft and lie angles.

Figure 24B:
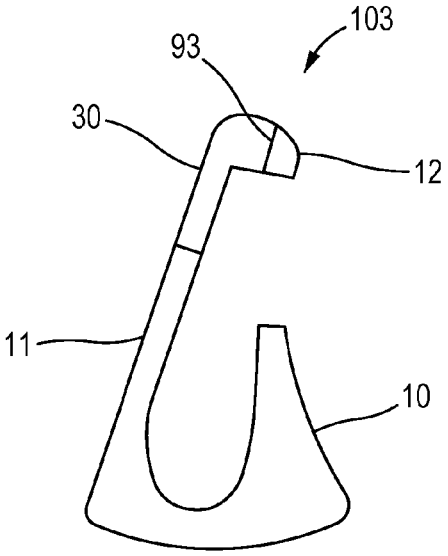

FIG. 24 provides a cross-sectional view along line BB in FIG. 24A. It can be seen that insert 30 is mounted on internal mounting surface 93 and provides a portion of the striking face of the club. It can also be seen that insert 30 extends lower than top line 12 when the club is at address, optimizing the weight benefits of insert 30.

Figure 25:
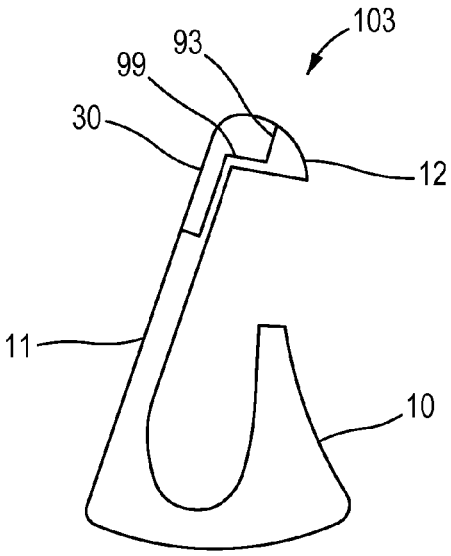
FIG. 25 shows an internal floor surface on a club head in which an insert provides part of the striking face.

FIG. 25 depicts an embodiment in which top line 12 comprises an internal floor surface 99 facing upwards when the club is at address. Floor surface 99 may extend forward from internal surface 93 and cooperates with the internal surface to define a recess.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIGS. 1 and 2. The direction references are included to facilitate comprehension of the inventive concepts disclosed herein, and should not be read or interpreted as limiting.

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

As used herein, the word "or" means "and or or", sometimes seen or referred to as "and/or", unless indicated otherwise.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. An iron-type golf club head comprising:

a body comprising a top line, a sole, a toe, a heel, a hosel extending up from the heel when the club head is at address, a front portion defining a ball-striking face, and a protrusion extending rearward from the body near the top line, the protrusion being essentially parallel to the top line;

a cavity defined in a back portion of the body, opposite the ball-striking face;

a first rear insert positioned within the cavity and coupled to a lower portion of the rear surface of the ball-striking face, and comprising a recess;

a weighted medallion positioned within the cavity and coupled to a rear surface of the ball-striking face via the first rear insert;

a second rear insert positioned within the cavity and coupled to an upper portion of the rear surface of the ball-striking face; and a third insert coupled to the protrusion.

2. The golf club head of claim 1, wherein the first rear insert and the weighted medallion form a mass-spring damping system configured to reduce or dissipate vibrations generated from impact between the ball-striking face and a ball.

3. The golf club head of claim 1, wherein the first rear insert is formed of a first material and the weighted medallion is formed of a second material.

4. The golf club head of claim 3, wherein the first and second materials are the same.

5. The golf club head of claim 3, wherein the first and second materials are different.

6. The golf club head of claim 3, wherein at least one of the first rear insert and the weighted medallion are formed of a viscoelastic material.

7. The golf club head of claim 1, wherein the first rear insert is coupled to a lower portion of the rear surface of the ball-striking face and the second rear insert is coupled to an upper portion of the rear surface of the ball-striking face, wherein the first and second rear inserts are in contact with one another.

8. The golf club head of claim 1, wherein the second rear insert comprises a material configured to be deformed and retained in a state of compression and exert a force upon the first rear insert to thereby retain the first and second rear inserts in respective positions within the cavity.

9. The golf club head of claim 1, further comprising a recess formed on an upper portion of the sole between the heel and the toe and a sole insert positioned within the recess.

10. The golf club head of claim 9, wherein the sole insert comprises a recess in which an additional weighted medallion is received.

11. The golf club head of claim 10, wherein the sole insert and the additional weighted medallion form a constrained-layer damping system configured to reduce or dissipate vibrations generated from impact between the ball-striking face and a ball.

* * * * *